US008353097B2

(12) United States Patent
Byun et al.

(10) Patent No.: US 8,353,097 B2
(45) Date of Patent: Jan. 15, 2013

(54) METHOD FOR FABRICATING ANTENNA DEVICE OF MOBILE COMMUNICATION TERMINAL

(75) Inventors: Joon-Ho Byun, Yongin-si (KR); Seong-Tae Jeong, Yongin-si (KR); Bum-Jin Cho, Hwaseong-si (KR); Soon-Ho Hwang, Seoul (KR); Yong-Soo Kwak, Suwon-si (KR); Austin Kim, Seongnam-si (KR); Jae-Hoon Jo, Seoul (KR); Jae-Hyung Kim, Seoul (KR); A-Hyun Sin, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 82 days.

(21) Appl. No.: 12/841,389

(22) Filed: Jul. 22, 2010

(65) Prior Publication Data

US 2011/0016702 A1 Jan. 27, 2011

(30) Foreign Application Priority Data

Jul. 22, 2009 (KR) ..... 10-2009-0066760

(51) Int. Cl.
*H01P 11/00* (2006.01)

(52) U.S. Cl. ..... 29/600; 29/592.1; 343/700 MS

(58) Field of Classification Search ..... 29/600, 29/592.2, 830–832; 343/700 MS, 702, 846–848, 343/860

See application file for complete search history.

(56) References Cited

U.S. PATENT DOCUMENTS

| | | | | |
|---|---|---|---|---|
| 6,323,811 | B1 * | 11/2001 | Tsubaki et al. | 343/700 MS |
| 6,875,328 | B2 * | 4/2005 | Tominaga et al. | 204/433 |
| 7,321,335 | B2 * | 1/2008 | Egorov et al. | 343/702 |
| 7,461,444 | B2 * | 12/2008 | Deaett et al. | 29/600 |
| 7,995,001 | B2 * | 8/2011 | Ohmi et al. | 343/911 R |
| 2002/0067312 | A1 * | 6/2002 | Hilgers | 343/700 MS |
| 2003/0063033 | A1 * | 4/2003 | Purr et al. | 343/700 MS |
| 2006/0192713 | A1 | 8/2006 | Kwak et al. | |
| 2007/0109203 | A1 * | 5/2007 | Park et al. | 343/702 |
| 2007/0207748 | A1 | 9/2007 | Toncich et al. | |

FOREIGN PATENT DOCUMENTS

JP 2008-167474 A 7/2008

* cited by examiner

*Primary Examiner* — Minh Trinh
(74) *Attorney, Agent, or Firm* — Jefferson IP Law, LLP

(57) ABSTRACT

A method for fabricating an antenna device of a mobile communication terminal, the method including selecting radiation patterns according to a usable frequency band, selecting and fabricating magneto dielectric modules for adjusting resonance frequencies of the selected radiation patterns, selecting and fabricating dielectric modules for adjusting resonance frequency of the selected radiation patterns, selecting and fabricating a radiation pattern having a number of resonance frequencies required for the terminal from among the radiation patterns selected in the pattern selection step, and selecting at least one of the magneto dielectric modules and the dielectric modules and installing it in the radiation pattern to tune a resonance frequency of the radiation pattern to the resonance frequency required for the terminal.

17 Claims, 29 Drawing Sheets

METHOD FOR FABRICATING ANTENNA DEVICE OF MOBILE COMMUNICATION TERMINAL

PRIORITY

This application claims the benefit under 35 U.S.C. §119 (a) of a Korean patent application filed in the Korean Intellectual Property Office on Jul. 22, 2009 and assigned Serial No. 10-2009-0066760, the entire disclosure of which is hereby incorporated by reference.

BACKGROUND OF THE INVENTION

1. Field of the Invention

The present invention generally relates to a mobile communication terminal. More particularly, the present invention relates to a method for fabricating an antenna device of a mobile communication terminal.

2. Description of the Related Art

Generally, the term 'mobile communication terminal' refers to a device carried with a user to perform communication, such as voice communication or text message transmission/reception, between the user and a communication partner. Recent years have witnessed innovative advances in mobile communication technology such that a user can download various contents provided from a mobile communication service provider through the mobile communication terminal and store the contents in the mobile communication terminal for use on the mobile communication terminal or enjoy those contents online.

Mobile communication services, which provided simple voice communication or text message transmission/reception in their early stage, are now additionally enabling the real-time transmission/reception of large amounts of information, from transmission/reception of various game contents and still/moving pictures to video communication.

Mobile communication services are provided in allocated frequency bands which may differ geographically and/or from service provider to service provider. Recently, mobile communication services provided in different frequency bands have become available with a single mobile communication terminal.

Meanwhile, as mobile communication services, which were focused on voice communication or short message transmission in their early stage, are now diversified from the transmission of game contents and still/moving pictures to video communication, terminal manufacturers have made continuous efforts to provide increasingly smaller terminals having large screens. That is, mobile communication terminals need to be easy to carry and allow users to enjoy multimedia services with sufficiently large screens during video communication or the viewing of moving pictures. In terms of portability and convenience in use of multimedia services, a portable terminal having a touch screen capable of providing both a keypad function as an input device and a display function as an output device has rapidly come into wide use.

To use mobile communication services provided in different frequency bands through a single mobile communication terminal, the mobile communication terminal has to be equipped with antennas operating in the respective frequency bands. However, due to the nature of antennas, interference generated between antennas operating in different frequency bands may lead to many difficulties in installing a plurality of antennas in a downsized terminal. Moreover, with the recent trend toward a built-in antenna which is disposed in a housing of a terminal, such difficulties have been aggravated.

Furthermore, because the characteristics of antennas may be significantly influenced by an adjacent circuit device or the shape of a terminal's housing, as well as interference between antennas operating in different frequency bands, an antenna for a new model of a terminal is designed through a trial and error process that inevitably involves numerous trials. In other words, for a new model of a terminal, a user can intuitively recognize only exterior and functional changes in the terminal. However, to design an antenna device for the new model of the terminal so as to have sufficient performance, a circuit layout and shape of a housing of the terminal as well as the design of the antenna device go through many trials and errors.

The trials and errors involved in the antenna design process require many man hours and are expensive, thereby increasing the fabricating cost of the terminal.

In addition, an antenna generally needs an electrical length of either a ¼ wavelength or ½ wavelength of a resonance frequency. An antenna operating in a high-frequency band (e.g., a band around 1.8 GHz or 2.1 GHz) is relatively easy to downsize. On the other hand, an antenna operating in a low-frequency band (e.g., a band around 800 MHz) needs a larger physical installation space than the antenna operating in the high-frequency band. Therefore, in the design of a multi-frequency-band antenna, there exist many difficulties in securing an installation space and guaranteeing the independent operating characteristics of the antenna operating in the low-frequency band with respect to the antenna operating in the high-frequency band.

SUMMARY OF THE INVENTION

An aspect of the present invention is to address at least the above-mentioned problems and/or disadvantages and to provide at least the advantages described below. Accordingly, an aspect of the present invention is to provide a method for fabricating an antenna device of a mobile communication terminal, which is favorable to downsizing of the mobile communication terminal.

Another aspect of the present invention is to provide a method for fabricating an antenna device of a mobile communication terminal, which allows the characteristics of the antenna device to be easily controlled even when a model of the mobile communication terminal is changed.

Still another aspect of the present invention is to provide a method for fabricating an antenna device of a mobile communication terminal, which can reduce the number of man hours and cost required for designing the antenna device by more easily controlling the characteristics of the antenna device.

Moreover, another aspect of the present invention is to provide a method for fabricating an antenna device of a mobile communication terminal, which can secure independent operating characteristics of antennas operating in respective multiple frequency bands and contribute to downsizing of the mobile communication terminal.

In accordance with an aspect of the present invention, a method for fabricating an antenna device of a mobile communication terminal is provided. The method includes selecting radiation patterns according to a usable frequency band, selecting and fabricating magneto dielectric modules for adjusting resonance frequencies of the selected radiation patterns, selecting and fabricating dielectric modules for adjusting resonance frequency of the selected radiation patterns, selecting and fabricating a radiation pattern having a number of resonance frequencies required for the terminal from among the radiation patterns selected in the pattern selection step, and selecting at least one of the magneto dielectric modules and the dielectric modules and installing it in the radiation pattern to tune a resonance frequency of the radiation pattern to the resonance frequency required for the terminal.

The selecting and fabricating of the radiation pattern may include forming the radiation pattern by forming a printed circuit on a circuit board embedded in the terminal.

In the selecting and installing of the at least one of the magneto dielectric modules and the dielectric modules in the radiation pattern, if at least one of the magneto dielectric modules is selected, the selected magneto dielectric module may be installed adjacent to a feeding end of the radiation pattern.

Each of the magneto dielectric modules is fabricated by forming a body made of a magneto dielectric material and installing a conductor on an outer circumferential surface of the body. The conductor may be in a helical shape which is wound once or twice around the body, or may be provided to surround an outer circumferential surface of the body. The magneto dielectric material may have a permeability of 2-9.

In the selecting and installing of the at least one of the magneto dielectric modules and the dielectric modules in the radiation pattern, if at least one of the dielectric modules is selected, the selected dielectric module may be spaced apart from a feeding end of the radiation pattern and may be installed in adjacent to an end portion of the radiation pattern. The dielectric module may have a permittivity of 1-10.

The selecting and installing of the at least one of the magneto dielectric modules and the dielectric modules in the radiation pattern may further include installing a separate radiator in the radiation pattern through surface-mounting, the radiator being fabricated by performing metal sheet working on a metal sheet.

The method may further include, after the selecting and fabricating of the radiation pattern, forming another radiation pattern, the other radiation pattern being adjacent to and spaced apart from the radiation pattern. The other radiation pattern may be a gap coupling line fed by current leaking from a ground or the radiation pattern.

The method may further include, after the selecting and fabricating of the radiation pattern, forming another radiation pattern adjacent to the radiation pattern and a switch module for selectively connecting the other radiation pattern to the radiation pattern.

At least a pair of other radiation patterns may be formed independently, and the switch module may connect one of the other radiation patterns to the radiation pattern. The other radiation pattern may be formed in connection with a ground of the circuit board.

If a specification of the terminal is changed, that is, a terminal of another model is fabricated, the antenna device suitable for the new model can be fabricated by repeating the selecting and fabricating of the radiation pattern and the selecting and installing of the at least one of the magneto dielectric modules and the dielectric modules in the radiation pattern.

The method for fabricating an antenna device of a mobile communication terminal can easily control the operating characteristics of a radiation pattern, especially, a resonance frequency thereof, formed in a pattern formation step by using one or a plurality of magneto dielectric modules or dielectric modules selected in first and second selection steps. Therefore, the operating characteristics of the radiation pattern can be controlled by selecting a proper one of the already selected magneto dielectric modules or dielectric modules, and by selecting another one of previously selected radiation patterns, an antenna device of a mobile communication terminal of another model can be easily fabricated. Hence, trial and error can be reduced in an antenna device designing process, and man hours and cost required for designing a new antenna device can be reduced.

In other words, although a process of radiation patterns, magneto dielectric modules, dielectric modules, and radiators would require a lot of time and effort at an initial stage, this may also be performed in the course of designing and testing and redesigning based on test results, which have been repeated in a conventional antenna fabricating process. By changing a combination of elements selected in the foregoing process, a new antenna device can be fabricated, thereby reducing man hours and cost required for designing or testing the new antenna device.

Moreover, a magneto dielectric module has a function of reducing a resonance frequency of a radiation pattern, contributing to downsizing of the antenna device. In other words, an electrically and physically larger radiation pattern is required as a resonance frequency decreases, but by installing the magneto dielectric module, a lower resonance frequency can be secured for the same-size radiation pattern, thereby downsizing the antenna device.

Furthermore, when the operating characteristics of a 2 dimensional (2D) radiation pattern in the form of a printed circuit pattern are controlled merely with a magneto dielectric module or a dielectric module, there is a limitation in improving the bandwidth or efficiency of the antenna device. However, by installing a radiator made by metal sheet working in the radiation pattern, the bandwidth and efficiency of the antenna device can be improved. This is possible because a 3 Dimensional (3D) radiation structure can be formed by adding the radiator to the antenna device in the 2D shape.

In addition, by installing a gap coupling line or a separate radiation pattern and a switch module, resonance frequency can be secured also in a frequency band other than a resonance frequency band of selected radiation patterns, thereby contributing to the implementation of the antenna device operating in multiple frequency bands.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
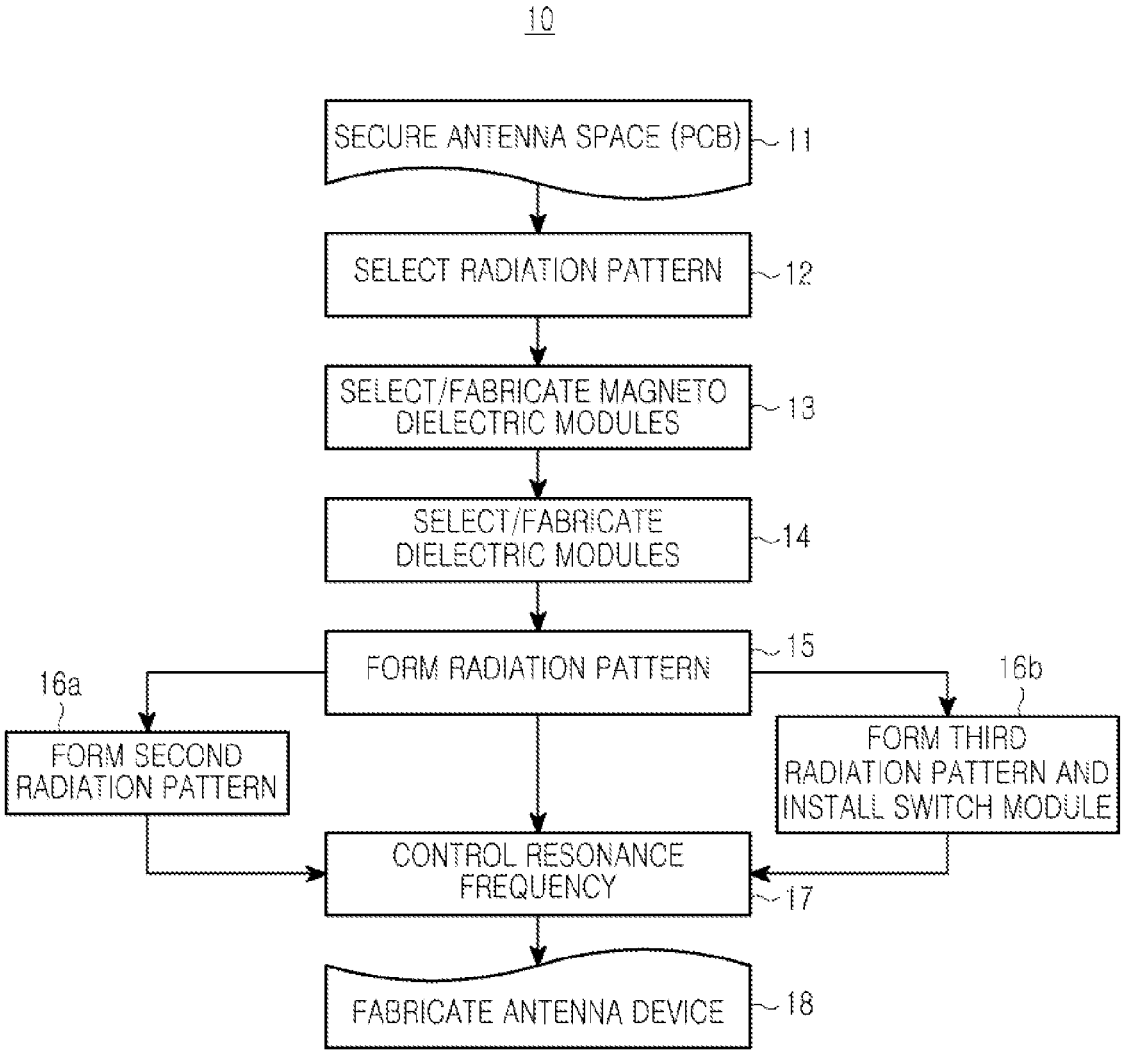
FIG. 1 is a flowchart of a method for fabricating an antenna device of a mobile communication terminal, according to an exemplary embodiment of the present invention.

FIG. 1 is a flowchart of a method for fabricating an antenna device of a mobile communication terminal, according to an exemplary embodiment of the present invention.

Referring to FIG. 1, in step 11 of the fabrication method 10 an antenna space is secured for installing the antenna device. In step 12, a radiation pattern is selected. In step 13, magneto dielectric or first dielectric modules are selected and/or fabricated. In step 14, dielectric modules are again selected and/or fabricated. In step 15, a radiation pattern is formed. In step 16*a*, a second radiation pattern is formed. In step 16*b*, a third radiation pattern is formed and a switch module is installed. In step 17, resonance frequency is controlled so as to be tuned. Thereafter, in step 18, the antenna device is fabricated by surface-mounting a radiation pattern and a magneto dielectric module acquired through the foregoing steps on a Printed Circuit Board (PCB) which is to be manufactured as a real product. The magneto dielectric modules or dielectric modules selected and/or fabricated in step 13 and step 14 are used to control a resonance frequency of a radiation pattern formed in the radiation pattern in step 15. In an exemplary embodiment of the present invention, a second radiation pattern may be formed in addition to the radiation pattern so as to form a gap coupling line, thereby securing an additional resonance frequency in addition to the resonance frequency of the radiation pattern. By using a third radiation pattern and a switch module, the resonance frequency of the radiation pattern may be shifted.

When securing the antenna space in step 11, a space for installing an antenna device on the PCB is secured which complies with a manufacturing specification such as an exterior design of a terminal after the manufacturing specification is roughly determined. This space may be allocated in a stage of planning the exterior design of the terminal. Generally, the antenna space allocated to the PCB is disposed on an upper portion or a lower portion of the PCB to avoid interference with other circuit devices.

Meanwhile, a built-in antenna may be structured such that a radiation pattern 113*a* is formed on a carrier 101*b* (see FIG. 5) or a PCB is formed on a substrate 101 to directly construct a radiation pattern 113 (see FIG. 2) thereon. In a case of a built-in antenna using a carrier, a microphone forming a transmission unit or a speaker phone forming a reception unit may be mounted on the carrier which is generally disposed on an upper end portion or a lower end portion of the terminal. In a case of a built-in antenna where a radiation pattern is formed on a circuit board, the radiation pattern is generally formed on an upper end portion or a lower end portion of the circuit board.

Once the antenna space is secured on the terminal or the PCB in step 11, rough radiation patterns are selected in step 12 according to a usable frequency band of a mobile communication service for which the terminal is to be used. Herein, 'the rough radiation patterns' are designed to be similar to an ultimate radiation pattern to be actually used according to the secured antenna space and the usable frequency band of the terminal. Thus, the detailed design of the rough radiation patterns needs to be changed according to a circuit layout and a shape of the terminal's housing, and so forth. It should be noted that the rough radiation patterns may be formed on an outer circumferential surface of a carrier by using a conductor. Alternatively, the rough radiation patterns may be formed by directly printing a conductive material on the PCB.

The rough radiation patterns may be represented by several forms according to the size or shape of a terminal (e.g., a bar type, a folder type, a slide type, or the like) and a usable frequency band of the terminal (e.g., a low-frequency band around 800 MHz or a high-frequency band around 1.8 GHz or 2.1 GHz).

More specifically, on the assumption that a terminal has a size range of 40-60 mm (width)×100-150 mm (length)×10-20 mm (thickness) considering portability of the terminal, the size of the terminal may be classified into one of three sizes, namely large, medium, and small. Some examples of the shape and usable frequency band of the terminal have already been described above. According to such classification, a radiation pattern used for an antenna device for a terminal of small size—bar type—dual bands around 800 MHz and 1.8 GHz as usable frequency bands may be designed as two or three types. Likewise, a radiation pattern used for an antenna device for a terminal of medium size—folder type—triple bands around 800 MHz, 1.8 GHz, and 2.1 GHz as usable frequency bands may also be designed as two or three types. Eventually, the radiation patterns that can be used according to the exterior and usable frequency band of the terminal are selected within a limited number of types, for example, two or three types in an initial designing process of the antenna device. Since characteristics required for an antenna device may differ according to detailed designs of terminals, even when the terminals are in the same shape and use the same frequency band, an antenna designer can select a proper radiation pattern from the selected radiation patterns and apply the proper radiation pattern to the terminal.

If the size, shape, and usable frequency band of the terminal are classified and the number of radiation patterns per classification is limited to one, a radiation pattern has to be newly designed, even in the event of a minor change in design conditions, such as a change in the design of the terminal. Similarly, too many radiation patterns per classification may cause difficulties in selecting a radiation pattern to be actually applied to the terminal. Consequently, taking these points into account, those of ordinary skill in the art should select a proper number of radiation patterns, and the number of radiation patterns per classification may not necessarily be limited to 2 or 3.

In step 13, magneto dielectric modules are selected and/or fabricated for controlling a resonance frequency of the radiation patterns selected in the pattern selection in step 12. Because the detailed design or circuit layout of the terminal is not sufficiently considered in the pattern selection in step 12, even when one of the selected radiation patterns is selected and actually applied to the terminal, the radiation characteristics of the selected radiation pattern needs to be controlled. Therefore, magneto dielectric modules or dielectric modules are selected and/or fabricated in step 13 and again in step 14, thereby controlling the radiation characteristics of the radiation pattern actually applied to the terminal.

FIGS. 2 through 10 are views for describing a process of selecting magneto dielectric modules according to exemplary embodiments of the present invention.

Figure 2:
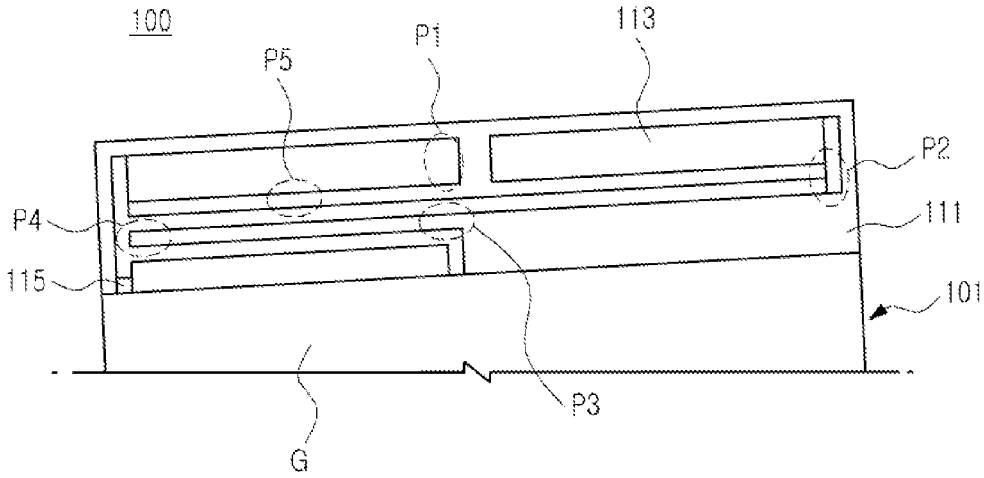
FIG. 2 is a plan view showing a radiation pattern used to select magneto dielectric modules for controlling a resonance frequency in a process of fabricating an antenna device, according to an exemplary embodiment of the present invention.

First, a description will be made of a process of selecting a radiation pattern to be used for a dual-band antenna device having a resonance frequency in a frequency band of 900-1000 MHz and in a frequency band of 1.8-1.9 GHz as shown in FIG. 2 to select magneto dielectric modules.

FIG. 2 is a plan view showing a radiation pattern used to select magneto dielectric modules for controlling a resonance frequency in a process of fabricating an antenna device, according to an exemplary embodiment of the present invention.

Referring to FIG. 2, the radiation pattern 113 which is to form an antenna device 100 includes a circuit pattern using a conductive material on an antenna space 111 formed on an upper end portion of a circuit board 101. A ground G is provided in the circuit board 101 such that a portion of the radiation pattern 113 is short-circuited to the ground G and a feeding end 115 is provided at an end portion of the radiation pattern 113.

Figure 3:
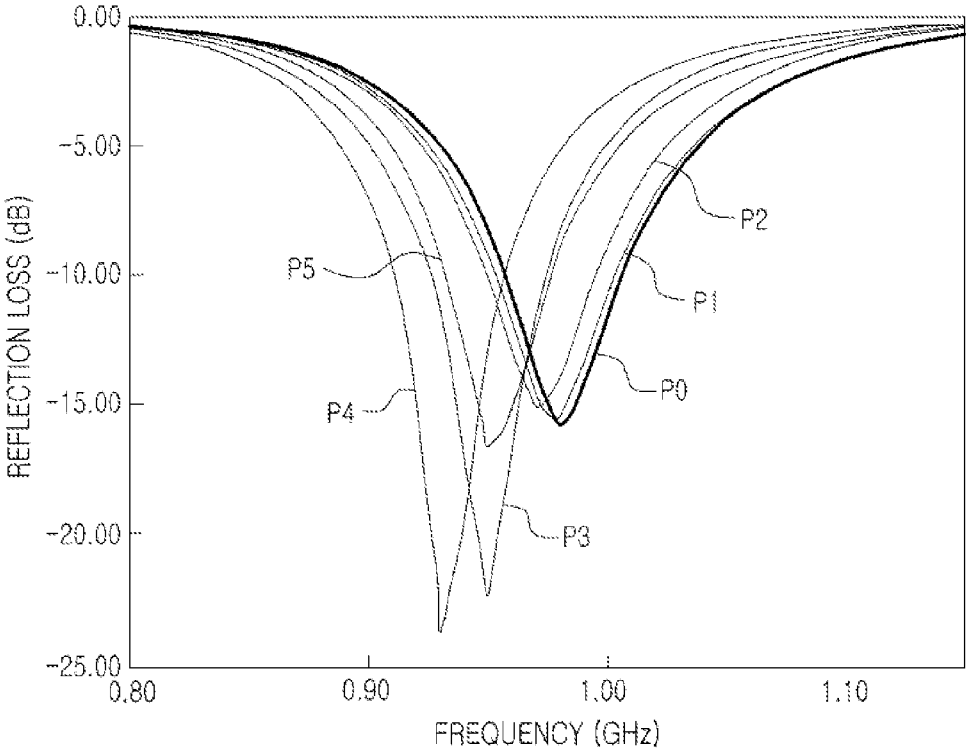
FIG. 3 is a graph showing a measurement result of operating characteristics of a radiation pattern in a low-frequency band when magneto dielectric modules are disposed in positions indicated in FIG. 2, according to an exemplary embodiment of the present invention.

FIG. 3 is a graph showing a measurement result of operating characteristics of a radiation pattern in a low-frequency band when magneto dielectric modules are disposed in positions indicated in FIG. 2, according to an exemplary embodiment of the present invention.

Figure 4:
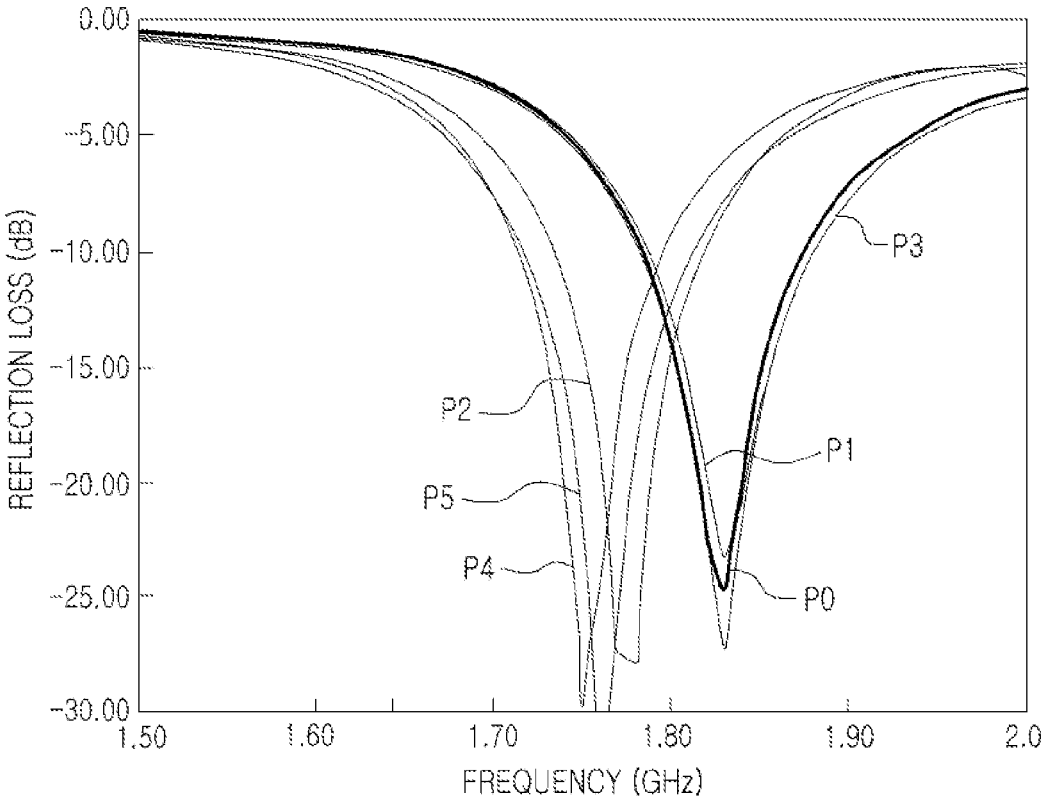
FIG. 4 is a graph showing a measurement result of operating characteristics of a radiation pattern in a high-frequency band when magneto dielectric modules are disposed in positions indicated in FIG. 2, according to an exemplary embodiment of the present invention.

FIG. 4 is a graph showing a measurement result of operating characteristics of a radiation pattern in a high-frequency band when magneto dielectric modules are disposed in positions indicated in FIG. 2, according to an exemplary embodiment of the present invention.

Referring to FIGS. 3 and 4, radiation characteristics of the radiation pattern 113 alone, prior to application of magneto dielectric modules thereto, are indicated by 'P0'.

Shown in FIGS. 3 and 4 are measurement results of radiation characteristics of the radiation pattern 113 where magneto dielectric modules are disposed on five positions P1, P2, P3, P4, and P5 shown in FIG. 2. The test was conducted by setting the permittivity and magnetic permeability of the magneto dielectric modules disposed on the radiation pattern 113 to 1 and 12, respectively.

In FIGS. 3 and 4, a large resonance frequency change occurs in the low-frequency band when the magneto dielectric modules are disposed on the positions P3, P4, and P5, and a large resonance frequency change occurs in the high-frequency band when the magneto dielectric modules are disposed on the positions P2, P4, and P5. In comparison to the resonance frequency of the radiation pattern 113 alone, before the magneto dielectric modules are applied thereto, the resonance frequency decreases both in the low-frequency band and in the high-frequency band when the magneto dielectric modules are disposed on the foregoing positions. In particular, the resonance frequency decreases by a similar amount both in the low-frequency band and in the high-frequency band for the positions P4 and P5. The positions P4 and P5 are adjacent to the feeding end 115, and as a result of measuring an electric field (E-field) and a magnetic field (H-field) of the radiation pattern 113, the H-field at the positions P4 and P5 is stronger than that in other positions of the radiation pattern 113.

In other words, to control the resonance frequency of the radiation pattern by using the magneto dielectric module, it is desirable to dispose the magneto dielectric module on a position where the H-field is stronger than that in other positions of the radiation pattern.

Next, radiation characteristic change of a radiation pattern with respect to a permeability change of a magneto dielectric module was measured by using an antenna device 200 where a radiation pattern 113*a* is formed of a conductor on an outer circumferential surface of a carrier 101*b*.

Figure 5:
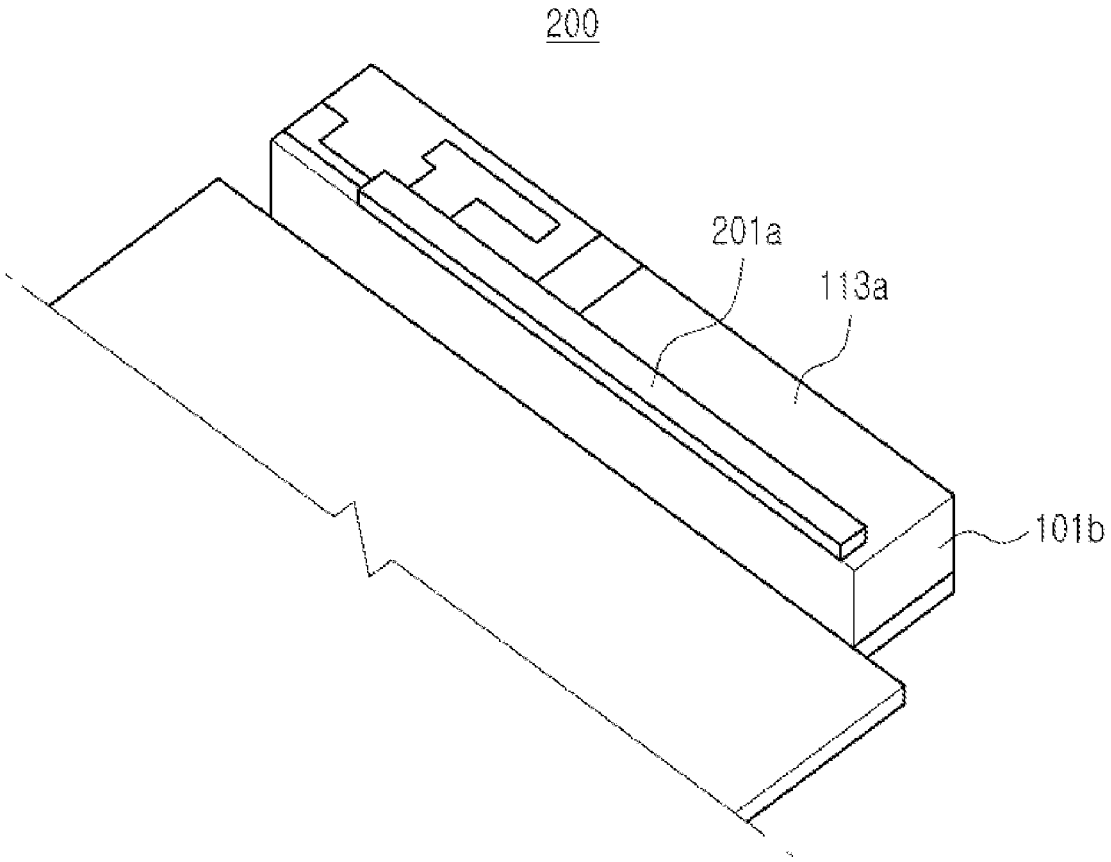
FIG. 5 is a perspective view showing a prototype of an antenna device for measuring a radiation characteristic change with respect to a magnetic permeability change of a magneto dielectric module, according to an exemplary embodiment of the present invention.

FIG. 5 is a perspective view showing a prototype of an antenna device for measuring a radiation characteristic change with respect to a magnetic permeability change of a magneto dielectric module, according to an exemplary embodiment of the present invention.

Referring to FIG. 5, a test radiation pattern 113*a* is shown that is fabricated for the measurement, in which the radiation pattern 113*a* is also used for the antenna device 200 in dual bands. A magneto dielectric module 201*a* installed on the radiation pattern 113*a*, formed in an elongated shape of a square rod, is disposed in a position on the radiation pattern 113*a* where an H-field is strong. The radiation characteristic change of the radiation pattern 113*a* was measured with a change in the permeability of the magneto dielectric module 201*a* from 2 to 20.

Figure 6:
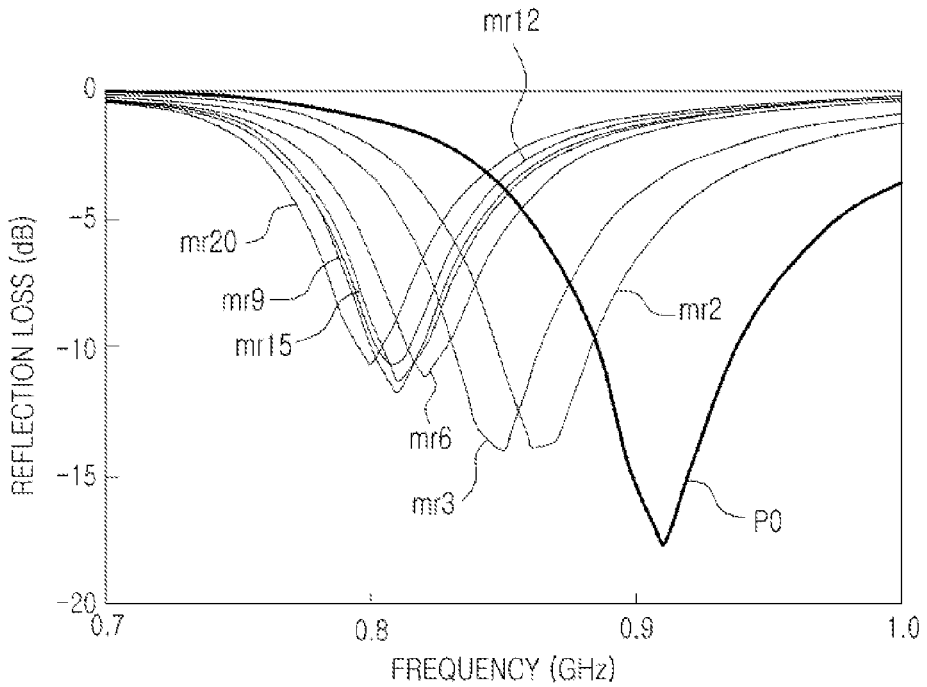
FIG. 6 is a graph showing a radiation characteristic change of an antenna device in a low-frequency band with respect to magnetic permeability change of a magneto dielectric module shown in FIG. 5, according to an exemplary embodiment of the present invention.

FIG. 6 is a graph showing a radiation characteristic change of an antenna device in a low-frequency band with respect to magnetic permeability change of a magneto dielectric module shown in FIG. 5, according to an exemplary embodiment of the present invention.

Figure 7:
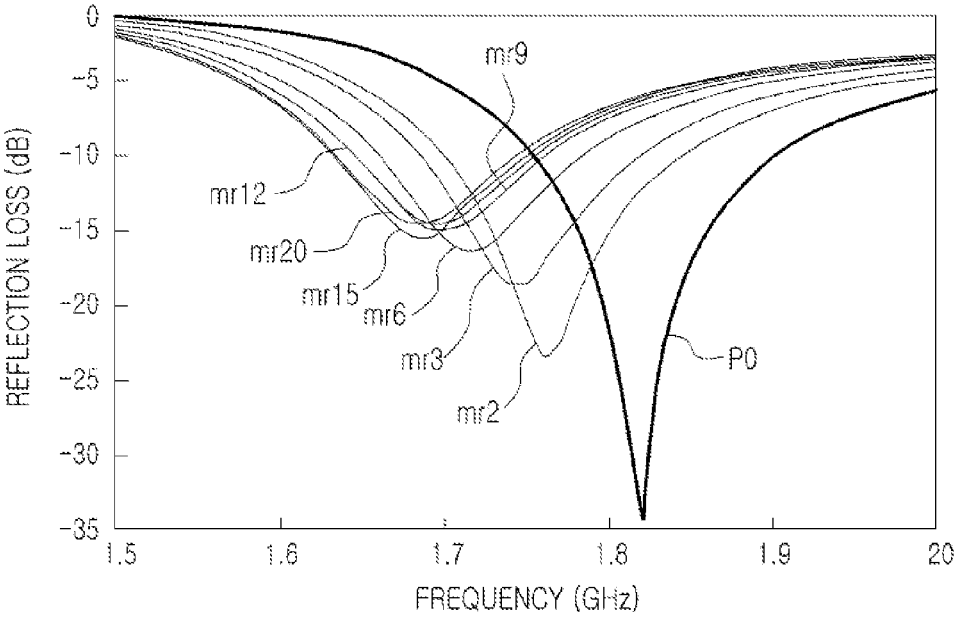
FIG. 7 is a graph showing a radiation characteristic change of an antenna device in a high-frequency band with respect to a magnetic permeability change of a magneto dielectric module shown in FIG. 5, according to an exemplary embodiment of the present invention.

FIG. 7 is a graph showing a radiation characteristic change of an antenna device in a high-frequency band with respect to a magnetic permeability change of a magneto dielectric module shown in FIG. 5, according to an exemplary embodiment of the present invention.

Referring to FIGS. 6 and 7, a resonance frequency change is shown with respect to permeability change of the magneto dielectric module 201*a* in the low-frequency band and in the high-frequency band. It can be seen from FIGS. 6 and 7 that both in the low-frequency band and in the high-frequency band, there is a relatively large resonance frequency change when the permeability of the magneto dielectric module 201*a* is in a range of 2-9 (i.e., mr2, mr3, mr6, and mr9). However, when the permeability exceeds 9 (i.e., mr12, mr15, and mr20), resonance frequencies are not much different from that corresponding to a permeability of 9 (i.e., mr9).

Therefore, to control the resonance frequency of the radiation pattern by using the permeability of the magneto dielectric module, it is desirable to determine the permeability within a range of 2-9. In a case where the permeability exceeds 9, the effectiveness of controlling the resonance frequency of the radiation pattern is low.

Figure 8:
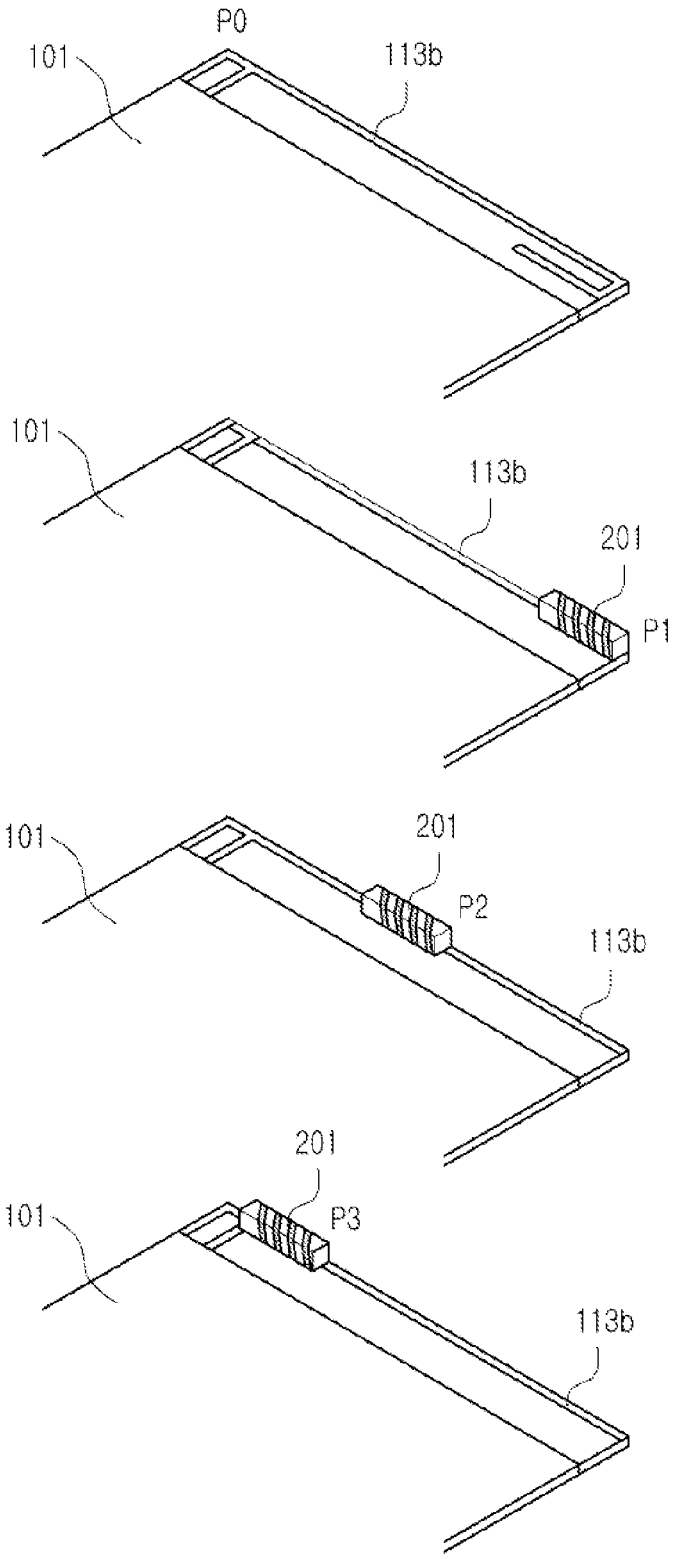
FIG. 8 is a perspective view showing a prototype of an antenna device for measuring a radiation characteristic change according to whether magneto dielectric modules are used and where the magneto dielectric modules are positioned, according to an exemplary embodiment of the present invention.

FIG. 8 is a perspective view showing a prototype of an antenna device for measuring a radiation characteristic change according to whether magneto dielectric modules are used and where the magneto dielectric modules are positioned, according to an exemplary embodiment of the present invention.

Referring to FIG. 8, an example is shown where a magneto dielectric module 201 is formed by winding a conductor in a helical shape around an outer circumferential surface of a body made of a magneto dielectric material, and the magneto dielectric module 201 is disposed in various positions on an inverted-F type antenna pattern 113*b*. By winding or surrounding the outer circumferential surface of the body with the conductor, a resonance frequency can be controlled more efficiently than by relying on the magneto dielectric material alone.

Figure 9:
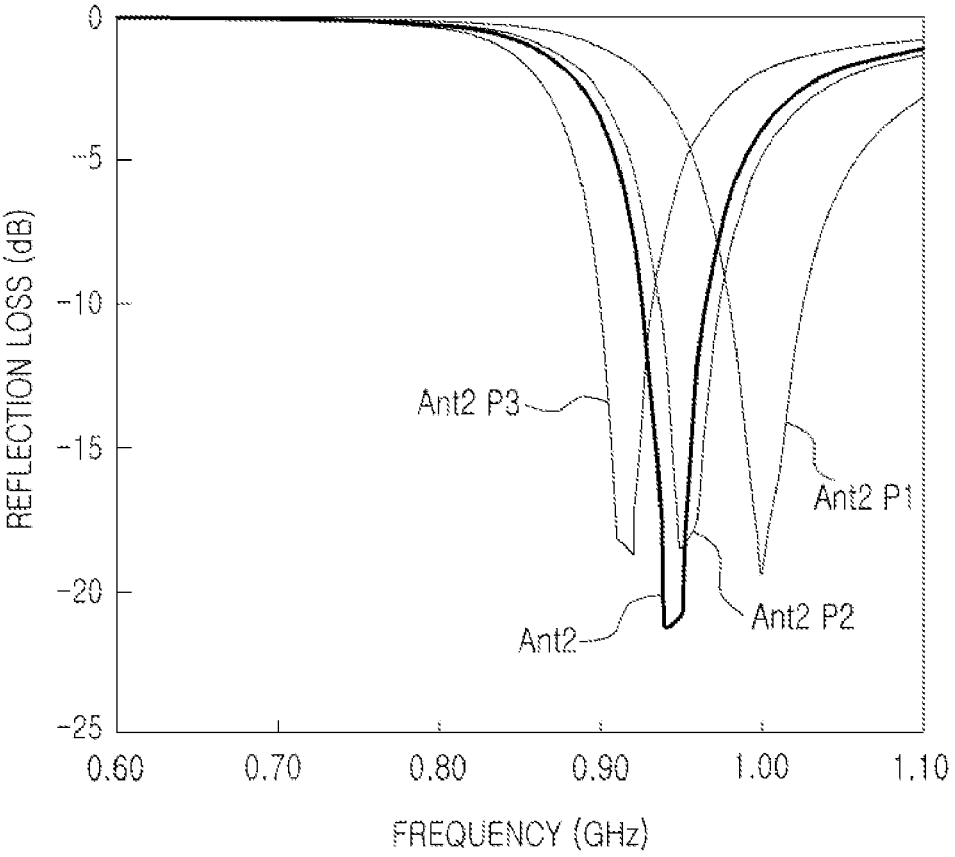
FIG. 9 is a graph showing a radiation characteristic change of an antenna device in a low-frequency band when dummies, instead of magneto dielectric modules, are disposed on various positions shown in FIG. 8, according to an exemplary embodiment of the present invention.

FIG. 9 is a graph showing a radiation characteristic change of an antenna device in a low-frequency band when dummies, instead of magneto dielectric modules, are disposed on various positions shown in FIG. 8, according to an exemplary embodiment of the present invention.

Figure 10:
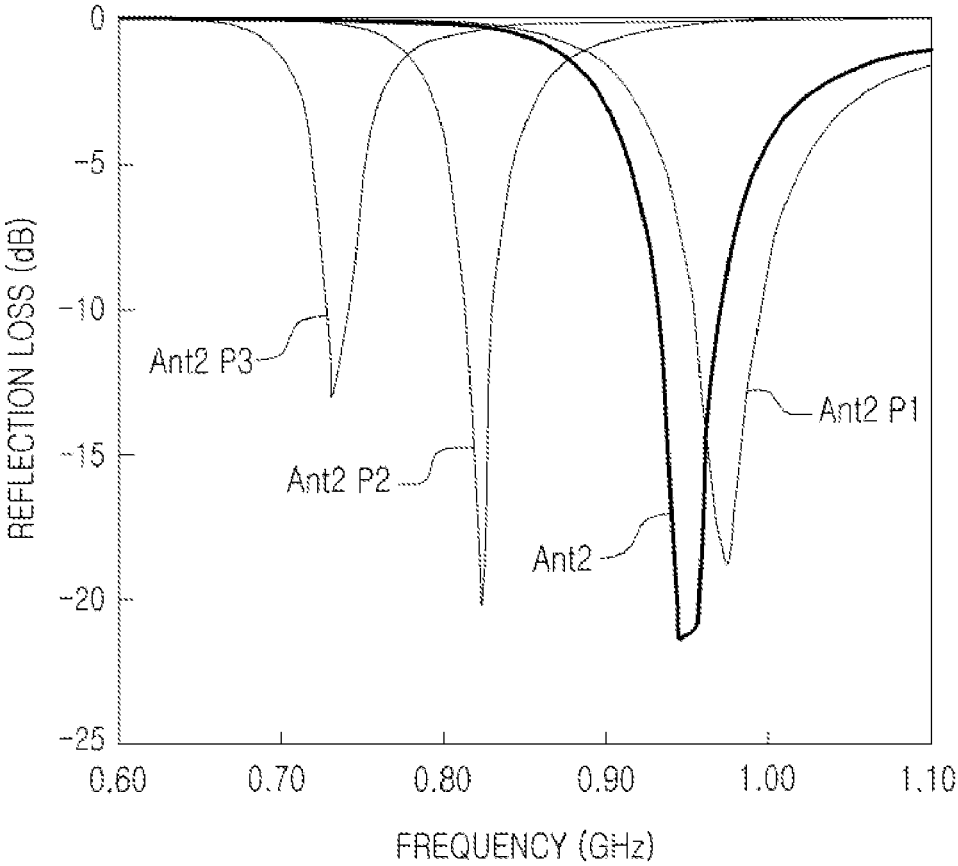
FIG. 10 is a graph showing a radiation characteristic change of an antenna device in a low-frequency band when magneto dielectric modules are disposed on various positions shown in FIG. 8, according to an exemplary embodiment of the present invention.

FIG. 10 is a graph showing a radiation characteristic change of an antenna device in a low-frequency band when magneto dielectric modules are disposed on various positions shown in FIG. 8, according to an exemplary embodiment of the present invention.

Referring to FIG. 9, shown is a resonance frequency change when the conductor is wound around the dummy which does not use a magneto dielectric material, and is disposed at each of positions P1, P2, and P3 shown in FIG. 8. Referring to FIG. 10, shown is a resonance frequency change when the conductor is wound around the outer circumferential surface of the body made of a magneto dielectric material to form the magneto dielectric module 201, and the magneto dielectric module 201 is disposed at each of the positions P1, P2, and P3 shown in FIG. 8. It should be noted that in FIGS. 9 and 10, a measurement value indicated by 'Ant2' represents radiation characteristics of the inverted-F type antenna pattern 113*b* before the dummy or the magneto dielectric module 201 is disposed.

Comparing FIG. 9 with FIG. 10, it can be seen that there is a change in resonance frequency when the dummy is wound with the conductor, but a larger resonance frequency change occurs by disposing the magneto dielectric module 201 using the magneto dielectric material on the inverted-F type antenna pattern 113*b*. It can also be seen from FIG. 10 that a larger resonance frequency change occurs as the magneto dielectric module 201 is disposed more adjacent to the feeding end.

Figure 26:
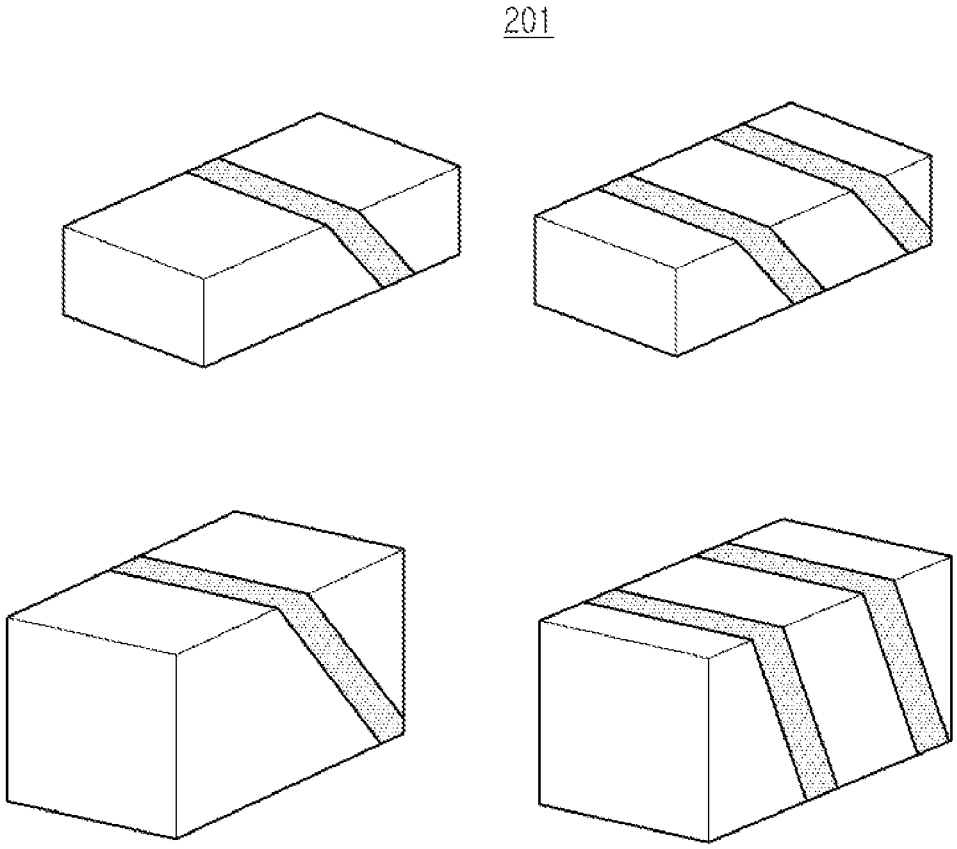
FIG. 26 illustrates selected magneto dielectric modules for use in controlling a resonance frequency to implement a fabrication method, according to an exemplary embodiment of the present invention.

FIG. 26 illustrates selected magneto dielectric modules for use in controlling a resonance frequency to implement a fabrication method, according to an exemplary embodiment of the present invention.

Referring to FIG. 26, exemplary magneto dielectric modules 201 are shown that are selected after the aforementioned tests. The magneto dielectric modules 201 shown in FIG. 26 have a size of 2 mm (width)×4 mm (length)×1 mm (or 2 mm; thickness) and a conductor is wound once or twice around an outer circumferential surface of a magneto dielectric material. The conductor may be wound four times around the outer circumferential surface of the magneto dielectric material as shown in FIG. 8, but the magneto dielectric modules 201 are selected to meet the above-described standard, taking account of electrical characteristics such as bandwidth loss and disposition of the magneto dielectric module 201 on a radiation pattern through surface-mounting.

As described above, the resonance frequency of the radiation pattern can be lowered by using the magneto dielectric module. That is, even when the radiation pattern of the same size is used, lower resonance frequency can be secured by using the magneto dielectric module. Generally, low usable frequency band may increase the electrical and physical length of the antenna, hindering the ability to downsize. In this situation, the magneto dielectric module may reduce a resonance frequency by being installed in the antenna having a small electrical and physical length, more specifically, in the radiation pattern, thereby contributing to the downsizing of the built-in antenna.

Next, the selection in step 14 of FIG. 1, which involves selecting and fabricating dielectric modules for controlling resonance frequencies of radiation patterns selected in the pattern selection in step 12 of FIG. 1 will be further discussed. In this step, the dielectric modules are selected and/or fabricated through a process similar to the selection in step 13.

Figure 11:
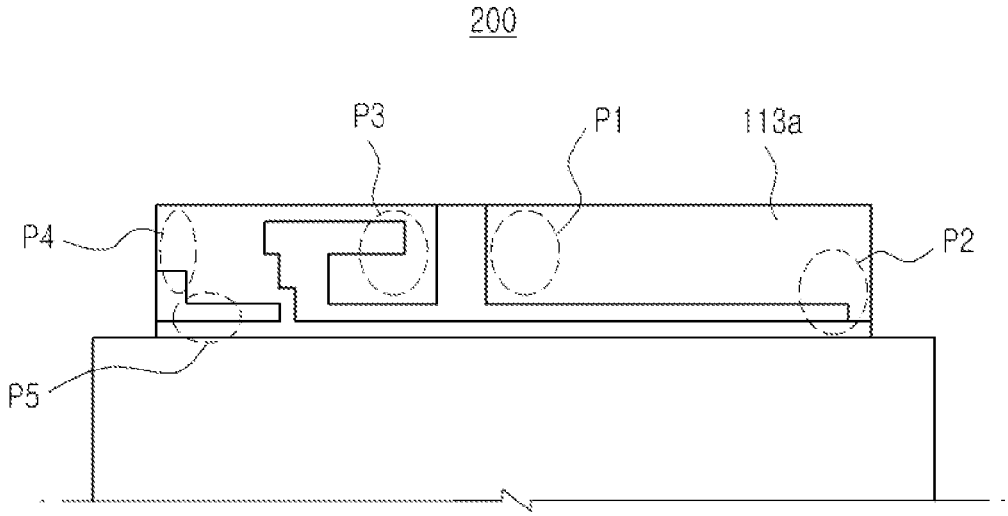
FIG. 11 is a plan view showing a radiation pattern used to select dielectric modules for controlling a resonance frequency in a process of fabricating an antenna device, according to an exemplary embodiment of the present invention.

FIG. 11 is a plan view showing a radiation pattern used to select dielectric modules for controlling a resonance frequency in a process of fabricating an antenna device, according to an exemplary embodiment of the present invention.

Referring to FIG. 11, the radiation pattern 113*a* is shown forming the built-in antenna using the carrier shown in FIG. 5. The radiation pattern 113*a* was fabricated for a test for measuring a radiation characteristic change of the radiation pattern 113*a* with respect to a position of a dielectric module. Shown in FIGS. 12 and 13 are radiation characteristics P0 prior to installation of the dielectric module and radiation characteristics P1, P2, P3, P4, and P5 after disposition of the dielectric module in positions of the radiation pattern 113*a* shown in FIG. 11.

Figure 12:
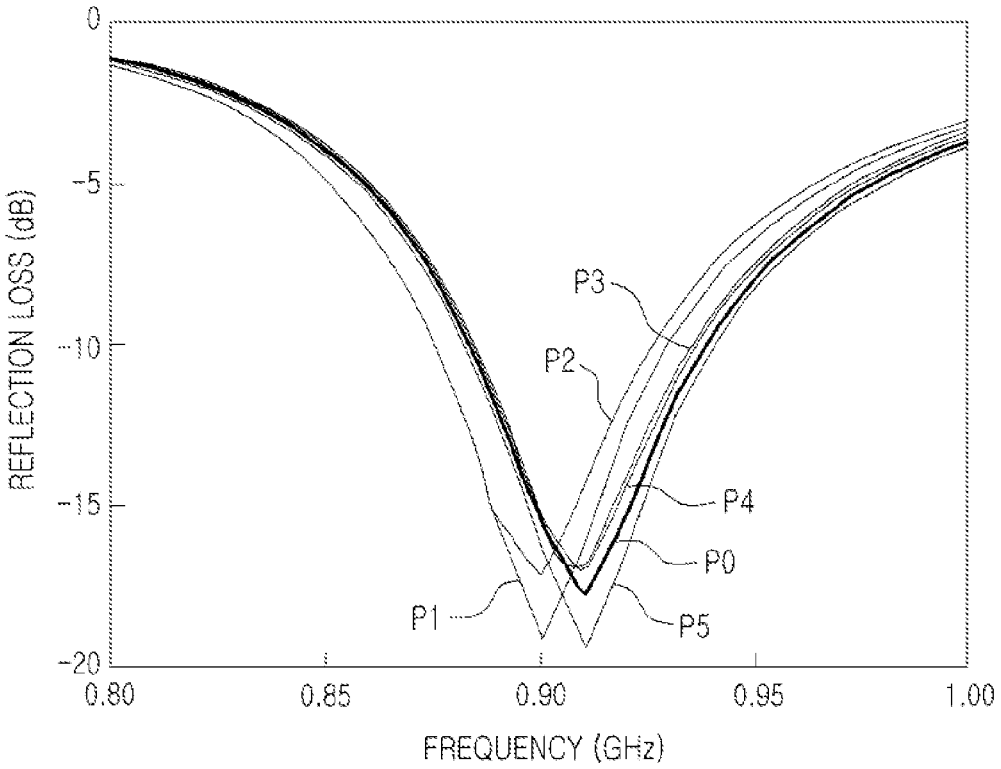
FIG. 12 is graph showing a measurement result of operating characteristics of a radiation pattern in a low-frequency band when dielectric modules are disposed in positions indicated in FIG. 11, according to an exemplary embodiment of the present invention.

FIG. 12 is graph showing a measurement result of operating characteristics of a radiation pattern in a low-frequency band when dielectric modules are disposed in positions indicated in FIG. 11, according to an exemplary embodiment of the present invention.

Figure 13:
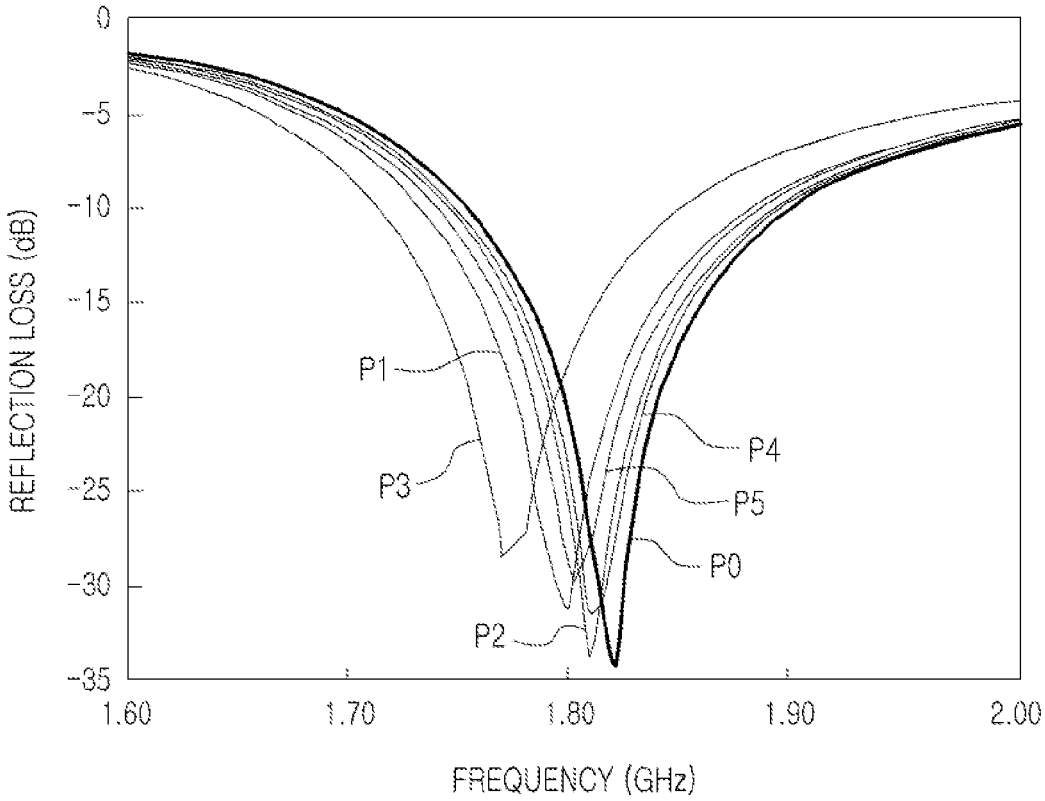
FIG. 13 is a graph showing a measurement result of operating characteristics of a radiation pattern in a high-frequency band when dielectric modules are disposed in the positions indicated in FIG. 11, according to an exemplary embodiment of the present invention.

FIG. 13 is a graph showing a measurement result of operating characteristics of a radiation pattern in a high-frequency band when dielectric modules are disposed in the positions indicated in FIG. 11, according to an exemplary embodiment of the present invention.

Figure 14:
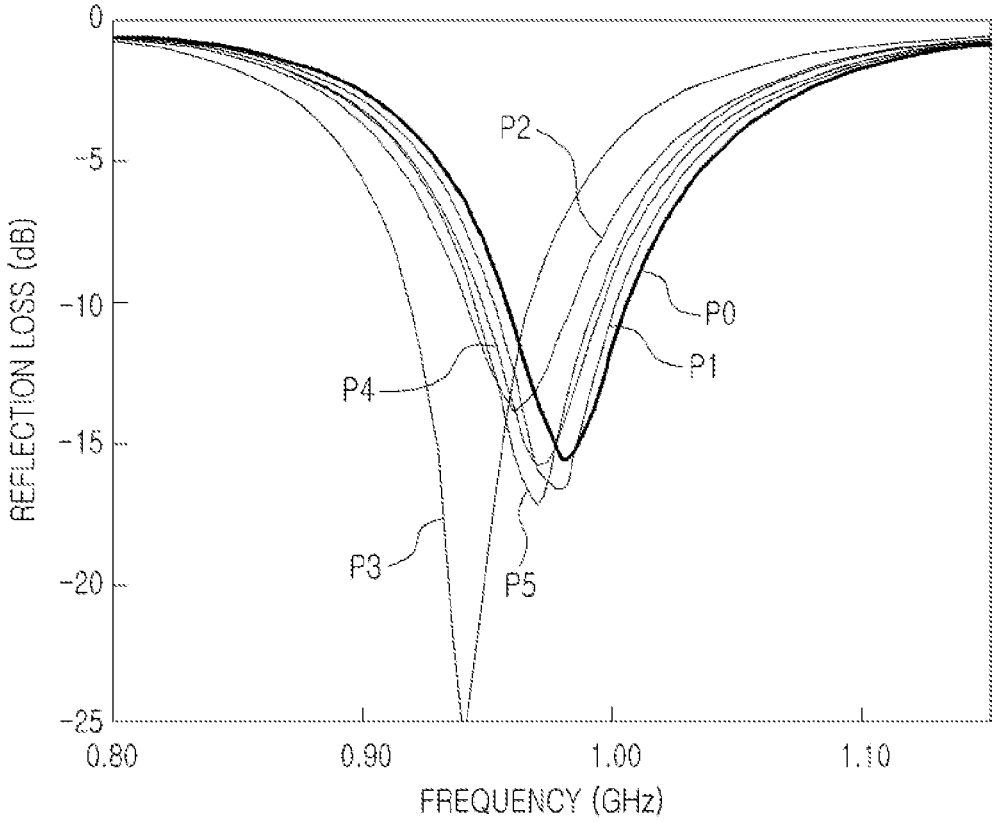
FIG. 14 is a graph showing a measurement result of operating characteristics of a radiation pattern in a low-frequency band when dielectric modules are disposed in the positions indicated in FIG. 2, according to an exemplary embodiment of the present invention.

FIG. 14 is a graph showing a measurement result of operating characteristics of a radiation pattern in a low-frequency band when dielectric modules are disposed in the positions indicated in FIG. 2, according to an exemplary embodiment of the present invention.

Figure 15:
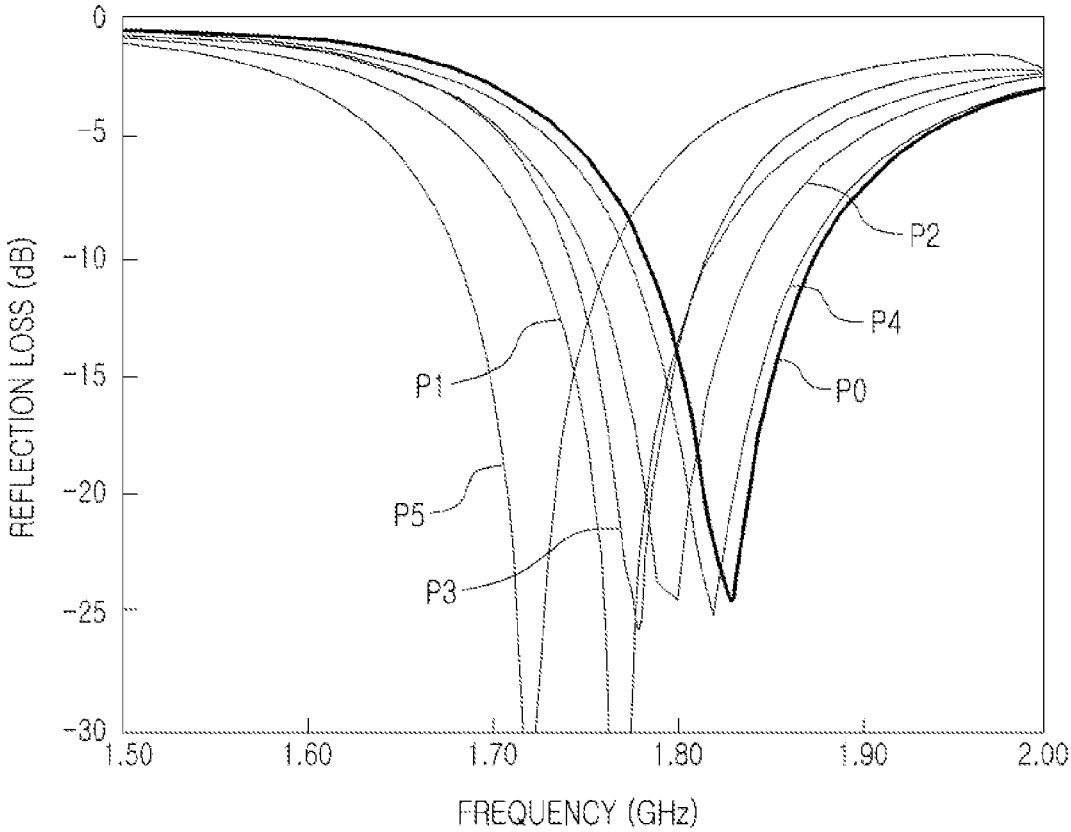
FIG. 15 is a graph showing a measurement result of operating characteristics of a radiation pattern in a high-frequency band when dielectric modules are disposed in the positions indicated in FIG. 2, according to an exemplary embodiment of the present invention.

FIG. 15 is a graph showing a measurement result of operating characteristics of a radiation pattern in a high-frequency band when dielectric modules are disposed in the positions indicated in FIG. 2, according to an exemplary embodiment of the present invention.

Referring to FIGS. 12 through 15, results are shown of measurements of radiation characteristics when a dielectric module is disposed at positions in a radiation pattern 113 in a printed circuit shown in FIG. 2. It should be noted that the radiation characteristic measurement results shown in FIGS. 12 through 15 have been acquired by using dielectric modules having a permittivity of 10 and a magnetic permeability of 1.

In FIGS. 12 and 13, it can be seen that, in the built-in antenna 200 using a carrier, a large change in a resonance frequency occurs when a dielectric module is disposed at P1 in the low-frequency band and is disposed at P3 in the high-frequency band. It can also be seen in FIGS. 14 and 15 that disposition of a dielectric module in the radiation pattern 113 in a printed circuit is more effective for resonance frequency control. In other words, when the dielectric module is disposed in the built-in antenna 100 having a radiation pattern in a printed circuit, a large resonance frequency change occurs at P1 and P3 in the low-frequency band and at P1 and P5 in the high-frequency band.

The analysis of positions at which a large resonance frequency change occurs by a dielectric module shows that those positions have stronger electric fields than other positions in the radiation pattern and are positions spaced apart from a feeding end, more preferably, are end portions of the radiation pattern spaced apart from the feeding end.

Next, a dielectric module is disposed in the built-in antenna 200 using a carrier, and a resonance frequency with respect to a permittivity of the dielectric module was measured.

Figure 16:
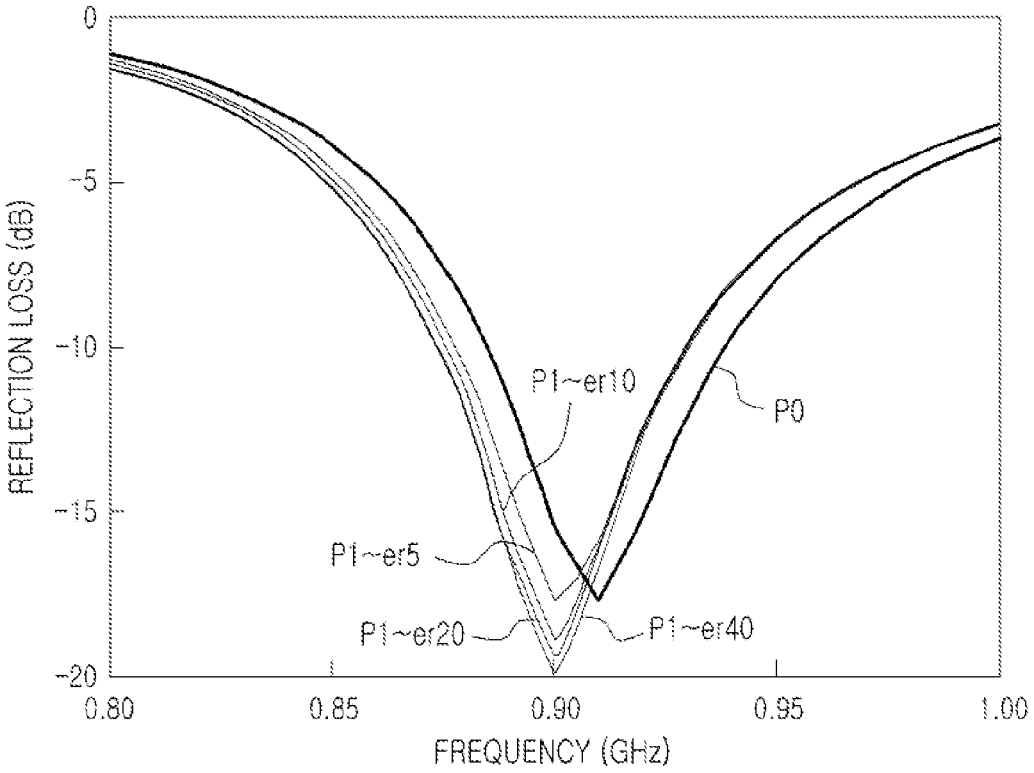
FIG. 16 is a graph showing a radiation characteristic change of an antenna device in a low-frequency band with respect to a permittivity change of a dielectric module when the dielectric module is disposed in a position P1 shown in FIG. 11, according to an exemplary embodiment of the present invention.

FIG. 16 is a graph showing a radiation characteristic change of an antenna device in a low-frequency band with respect to a permittivity change of a dielectric module when the dielectric module is disposed in a position P1 shown in FIG. 11, according to an exemplary embodiment of the present invention.

Figure 17:
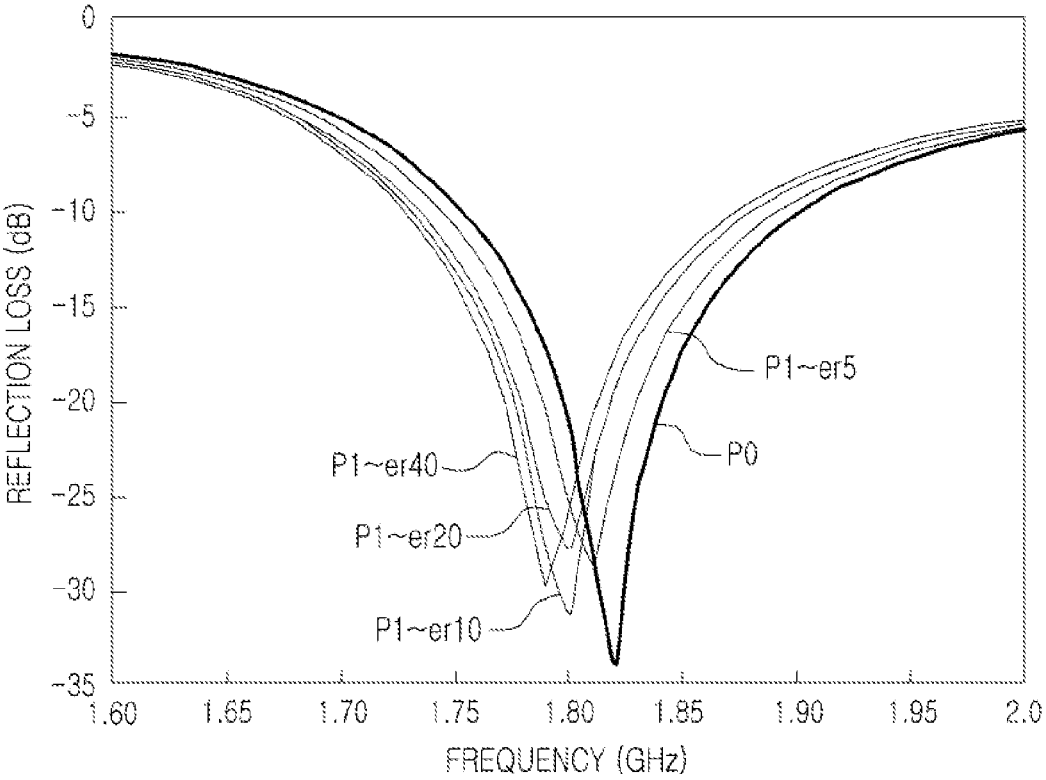
FIG. 17 is a graph showing a radiation characteristic change of an antenna device in a high-frequency band with respect to a permittivity change of a dielectric module when the dielectric module is disposed in a position P1 shown in FIG. 11, according to an exemplary embodiment of the present invention.

FIG. 17 is a graph showing a radiation characteristic change of an antenna device in a high-frequency band with respect to a permittivity change of a dielectric module when the dielectric module is disposed in a position P1 shown in FIG. 11, according to an exemplary embodiment of the present invention.

Figure 18:
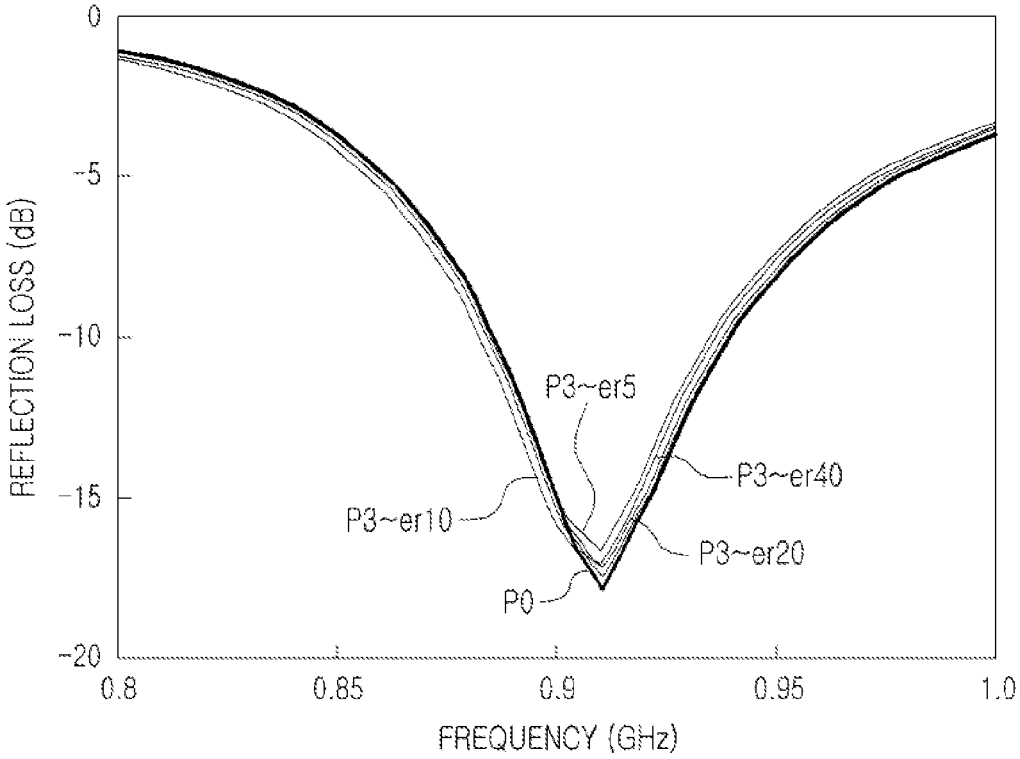
FIG. 18 is a graph showing a radiation characteristic change of an antenna device in a low-frequency band with respect to a permittivity change of a dielectric module when the dielectric module is disposed in a position P3 shown in FIG. 11, according to an exemplary embodiment of the present invention.

FIG. 18 is a graph showing a radiation characteristic change of an antenna device in a low-frequency band with respect to a permittivity change of a dielectric module when the dielectric module is disposed in a position P3 shown in FIG. 11, according to an exemplary embodiment of the present invention.

Figure 19:
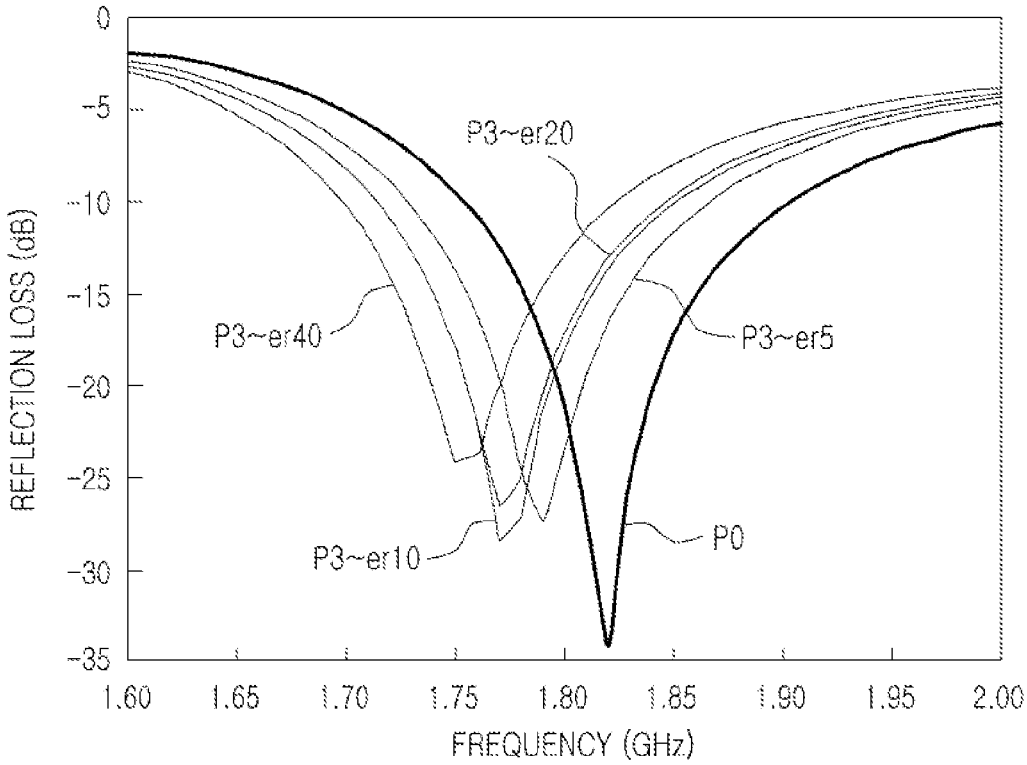
FIG. 19 is a graph showing a radiation characteristic change of an antenna device in a high-frequency band with respect to a permittivity change of a dielectric module when the dielectric module is disposed in a position P3 shown in FIG. 11, according to an exemplary embodiment of the present invention.

FIG. 19 is a graph showing a radiation characteristic change of an antenna device in a high-frequency band with respect to a permittivity change of a dielectric module when the dielectric module is disposed in a position P3 shown in FIG. 11, according to an exemplary embodiment of the present invention.

Referring to FIGS. 16 through 19, graphs are shown that include the results of the measurement. In FIGS. 16 and 17, measurement results are shown of when the dielectric module is disposed at P1 which has a large influence upon the resonance characteristics of the low-frequency band. In FIGS. 18 and 19, measurement results are shown of when the dielectric module is disposed at P3 which has a large influence upon the resonance characteristics of the high-frequency band.

Here, the permittivity of the dielectric module disposed at P1 and P3 of the built-in antenna 200 was gradually changed from 5 to 40 to measure an influence upon resonance frequency.

It can be seen from FIGS. 16 and 17 that, when the dielectric module is disposed at P1 of the built-in antenna 200 and the permittivity thereof is changed, a large change occurs in resonance frequency at a permittivity of 5 (i.e., er5) and little change in resonance frequency occurs at permittivities exceeding 5 (i.e., er10, er20, and er40), in comparison to the resonance frequency at the permittivity of 5, in the low-frequency band. In the previous test, little change occurs in the high-frequency band when the dielectric module is disposed at P1. However, a change in resonance frequency at P1 is detected due to a change in permittivity of the dielectric module. According to the analysis, this change results from harmonic components caused by the resonance frequency in the low-frequency band.

It can be seen from FIGS. 18 and 19 that a change in resonance frequency is small at permittivities exceeding 10 (i.e., er20 and er40) in the low-frequency band when the dielectric module is disposed at P3 of the built-in antenna 200 and the permittivity thereof is changed.

The foregoing test results show that the effectiveness of resonance frequency control with a permittivity change is degraded when the permittivity of the dielectric module is out of a range of 1-10 with slight variation according to the position of the dielectric module in the radiation pattern.

A dielectric module may also be patterned by winding a conductor around an outer circumferential surface thereof, like a magneto dielectric module described above, and three or four dielectric modules or more may be selected and/or fabricated through the foregoing tests. However, the number of magneto dielectric modules and the number of dielectric modules may be properly selected by those of ordinary skill in the art, similar to the number of radiation patterns. For example, the number of radiation patterns or the number of magneto dielectric modules may be determined, taking account of the number of terminals produced per year and the number of models released per year of a manufacturer.

Once radiation patterns, magneto dielectric modules, and dielectric modules are selected through the foregoing procedure, the selected radiation patterns are formed by the pattern formation in step 15 of FIG. 1, and proper ones are selected from among the selected magneto dielectric modules and dielectric modules to secure radiation characteristics required for an actually manufactured terminal. 'Securing the radiation characteristics' refers to, for example, the frequency resonance control in step 17 of FIG. 1, which will be referred to as a 'tuning step'.

The resonance frequency control is performed by selecting at least one of the selected magneto dielectric modules or dielectric modules. If it is not easy to control the characteristics of the radiation pattern formed by a combination of the selected magneto dielectric modules or dielectric modules, an actual radiation pattern is formed by selecting another among the selected radiation patterns and the resonance frequency of the radiation pattern is controlled.

The actually formed radiation pattern may be modified if necessary, but the radiation characteristics substantially required for the terminal can be secured by a combination of the magneto dielectric modules or dielectric modules.

Since the radiation pattern in the printed circuit is formed on a plane, it is formed only in a two-dimensional (2D) shape. Such a limitation narrows transmission/reception frequency bandwidth of the radiation pattern and degrades efficiency due to the permittivity of the circuit board. To address these problems, most commercialized mobile communication terminals include a built-in antenna using a carrier described above.

When a radiation pattern is formed on an outer circumferential surface of the carrier, the carrier, as well as the radiation pattern, has to be redesigned according to changes in the design or circuit layout of a terminal. Such a disadvantage may be supplemented by a radiation pattern in a printed circuit, but the radiation pattern in the printed circuit narrows bandwidth or degrades efficiency.

The disadvantages of the radiation pattern in the printed circuit, that is, the bandwidth and efficiency problems may be addressed by adding a three-dimensional (3D) radiator to the radiation pattern in the printed circuit. Various shapes of the radiator are shown in FIG. 20.

Figure 20:
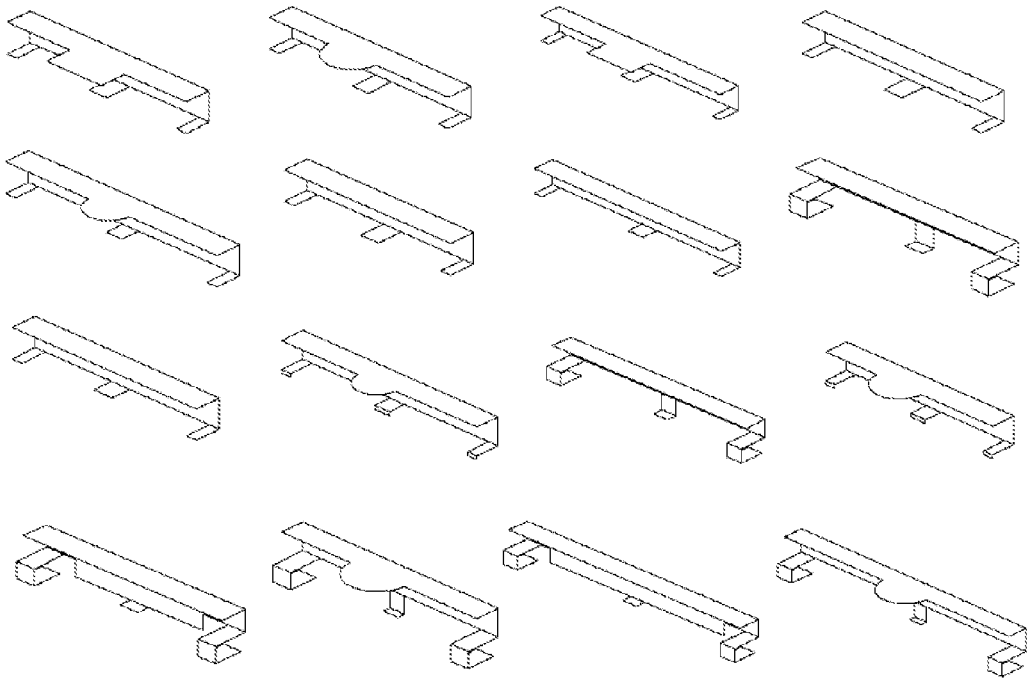
FIG. 20 illustrates radiators that can be added to a radiation pattern in a process of fabricating an antenna device, according to an exemplary embodiment of the present invention.

FIG. 20 illustrates radiators that can be added to a radiation pattern in a process of fabricating an antenna device, according to an exemplary embodiment of the present invention.

Referring to FIG. 20, 16 exemplary shapes of the radiator are shown. The radiator may be fabricated by sheet metal working which cuts or bends a metal sheet, and is installed on the radiation pattern. It is preferable that the radiator be manufactured with a specification allowing surface mounting, and a distance between the ground and a portion which actually radiates electric waves is controlled by installation of the radiation pattern, thereby improving the transmission/reception frequency bandwidth and the efficiency. Although 16 shapes of the radiator are shown in FIG. 20, it is desirable for those of ordinary skill in the art to properly determine the number of radiators, similar to the number of radiation patterns or magneto dielectric modules as described above.

By using the radiator, the radiation characteristics of the antenna device can be controlled in the tuning in step 17 of FIG. 1. In other words, by fabricating a separate radiator and installing it on the radiation pattern, bandwidth or efficiency can be improved.

Figure 27:
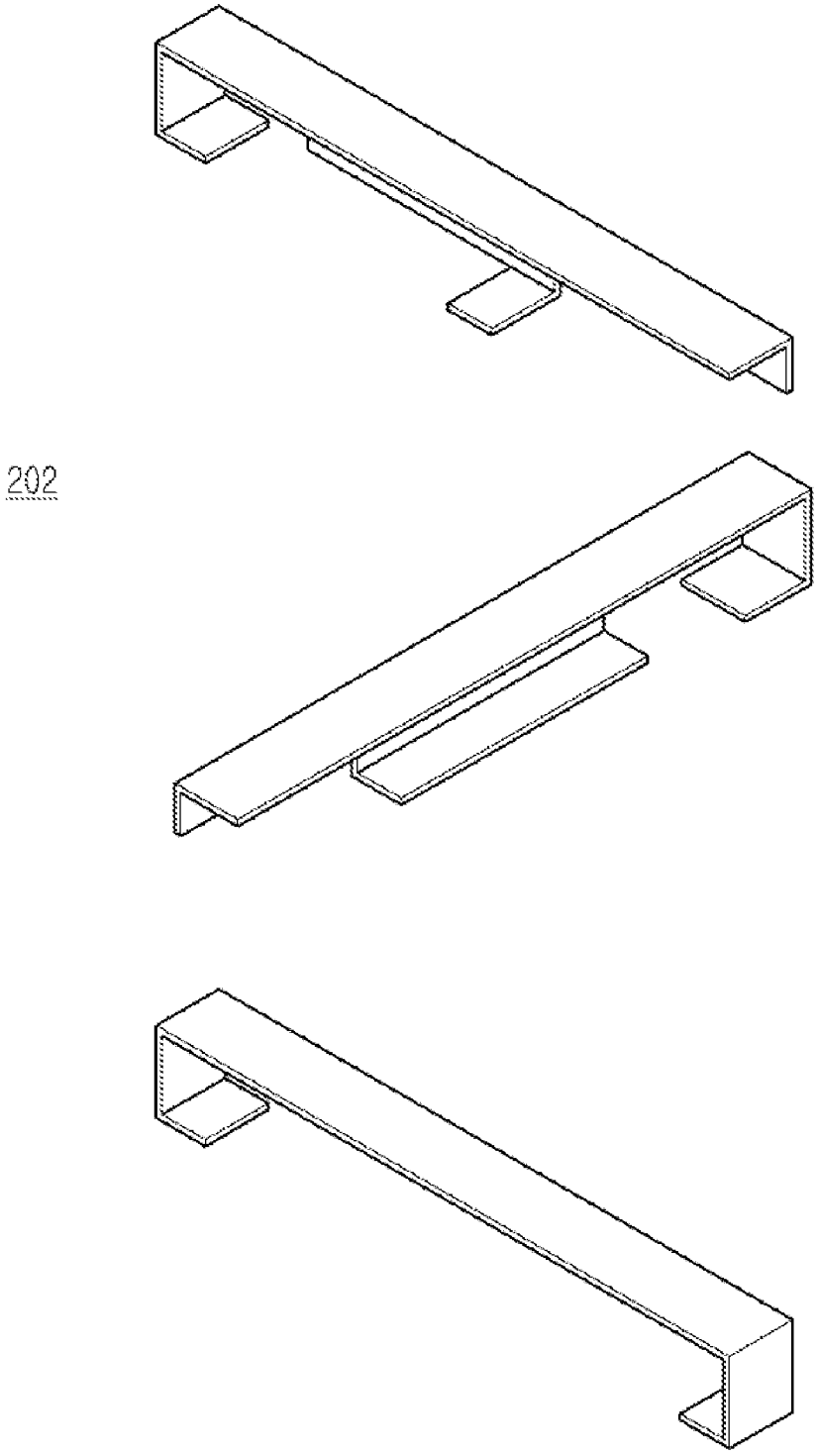
FIG. 27 illustrates selected radiators from among radiators in various shapes, for use in implementing a fabrication method, according to an exemplary embodiment of the present invention.

FIG. 27 illustrates selected radiators from among radiators in various shapes, for use in implementing a fabrication method, according to an exemplary embodiment of the present invention.

Referring to FIG. 27, actually fabricated radiators 202 for improving bandwidth or efficiency of a 2D radiation pattern are shown. Upon completion of resonance frequency control, an antenna device having a combination, that is, a combination of a radiation pattern, a magneto dielectric module, and a dielectric module, or a combination additionally including a radiator is completed. Antenna devices to be applied to actual terminals are mass-produced based on the completed antenna device. Since radiation patterns, magneto dielectric modules, dielectric modules, and radiators which meet basic requirements of terminals have already been fabricated in various shapes, even if some design requirements are changed during a process of designing a terminal, a designer of the antenna device can form the antenna device to meet the changed requirements by using already selected elements. That is, by repeating only a step of controlling radiation characteristics, more specifically, resonance frequency, by using already selected radiation patterns and magneto dielectric modules, the antenna device suitable for the changed requirements of the terminal can be fabricated.

Even if a completely new terminal is fabricated from the beginning, an antenna device suitable for the new terminal can be fabricated by a proper combination of previously selected/fabricated radiation pattern and magneto dielectric modules, without a need to newly design the radiation pattern and the magneto dielectric modules.

That is, redesigning and fabricating of the radiation pattern, and characteristic testing of the fabricated radiation pattern, which have been repeated in a conventional antenna designing process, can be skipped.

Moreover, the fabrication method according to exemplary embodiments of the present invention can secure an additional resonance frequency in addition to a resonance frequency of an already fabricated radiation pattern or change the resonance frequency by forming a gap coupling line or an additional radiation pattern and switch modules (i.e., steps 16*a* and 16*b* of FIG. 1).

The gap coupling line refers to an additional radiation pattern ('second radiation pattern') formed adjacent to a radiation pattern ('first radiation pattern') in a printed circuit. The second radiation pattern can secure an additional resonance frequency without changing radiation characteristics of the first radiation pattern, such as the resonance frequency of the first radiation pattern. In other words, the antenna device is fabricated by forming the second radiation pattern in the form of a gap coupling line adjacent to the first radiation pattern in dual frequency bands, thereby forming the antenna device operating in three different frequency bands. Since the second radiation pattern may be formed in the form of a printed circuit, it may be easily formed during formation of the first radiation pattern, without incurring additional cost.

The second radiation pattern in the form of a gap coupling line is disposed adjacent to a feeding end of the first radiation pattern and is fed by current leaking from the feeding end without being connected to the ground ('first scheme'); is connected to the ground and is fed by current that is formed in the ground by feeding of the first radiation pattern ('second scheme'); or is connected to the ground and is disposed adjacent to the feeding end of the first radiation pattern to be fed by current formed in the first radiation pattern and current formed in the ground ('third scheme').

Figure 21:
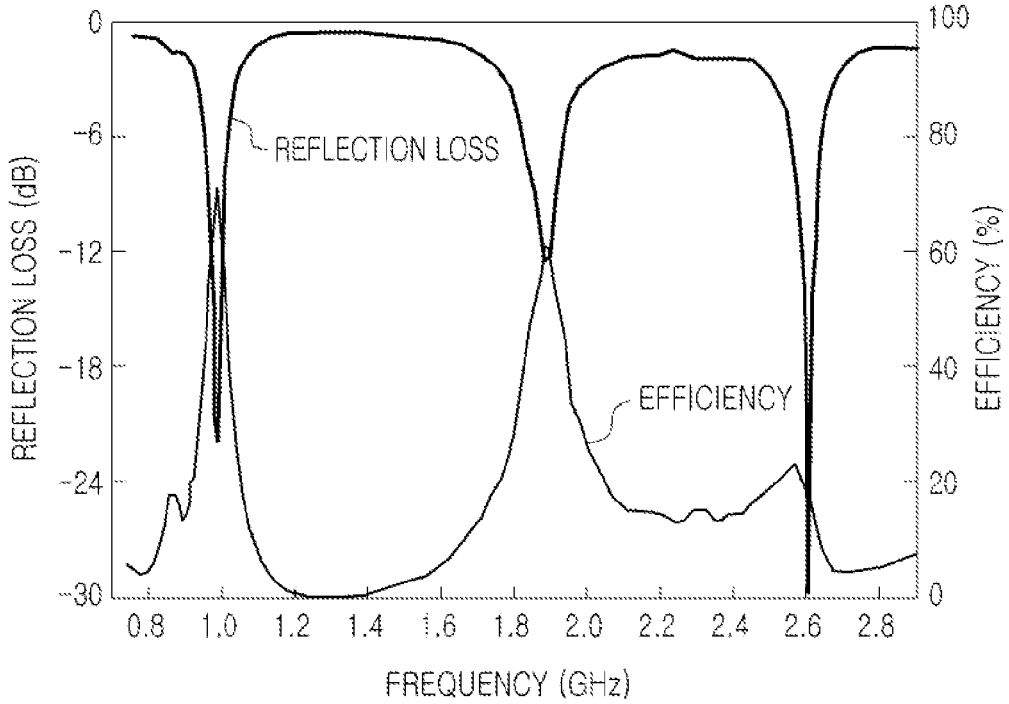
FIG. 21 is a graph showing radiation characteristics of an antenna device when a gap coupling line fed by current leaking from a radiator is added, according to an exemplary embodiment of the present invention.

FIG. 21 is a graph showing radiation characteristics of an antenna device when a gap coupling line fed by current leaking from a radiator is added, according to an exemplary embodiment of the present invention.

Referring to FIG. 21, shown are results of a measurement of the radiation characteristics of the antenna device when the second radiation pattern is formed in the above-described first scheme in the radiation pattern shown in FIG. 2. As mentioned above, the radiation pattern itself has a resonance frequency in a frequency band of 900-1000 MHz and in a frequency band of 1.8-1.9 GHz. However, when the second radiation pattern is formed in the first scheme, resonance frequency can also be secured in a frequency band around 2.6 GHz without a large change in the original resonance frequency.

Figure 22:
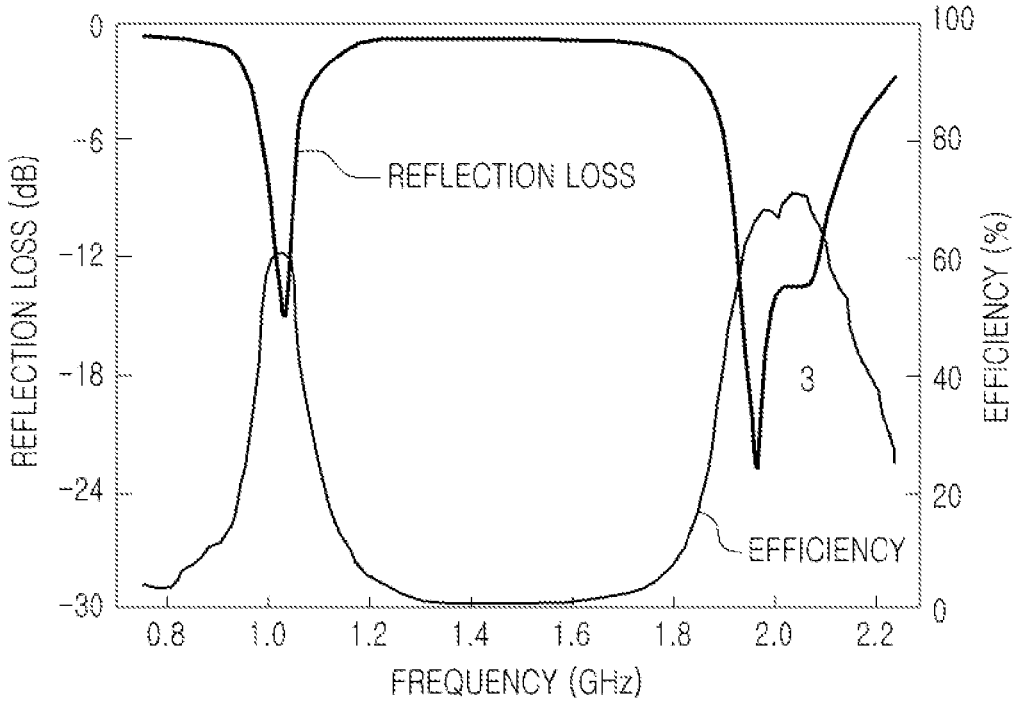
FIG. 22 is a graph showing radiation characteristics of an antenna device when a gap coupling line connected to a ground and fed by current leaking from the ground is added, according to an exemplary embodiment of the present invention.

FIG. 22 is a graph showing radiation characteristics of the an antenna device when a gap coupling line connected to a ground and fed by current leaking from the ground is added, according to an exemplary embodiment of the present invention.

Referring to FIG. 22, shown are results of a measurement of the radiation characteristics of the antenna device when the second radiation pattern is formed in the above-described second scheme in the radiation pattern shown in FIG. 2. As can be seen in FIG. 22, when the second radiation pattern is formed in the second scheme, resonance frequency can also be secured in a frequency band of 2.0-2.2 GHz with a small change in the original resonance frequency.

Figure 23:
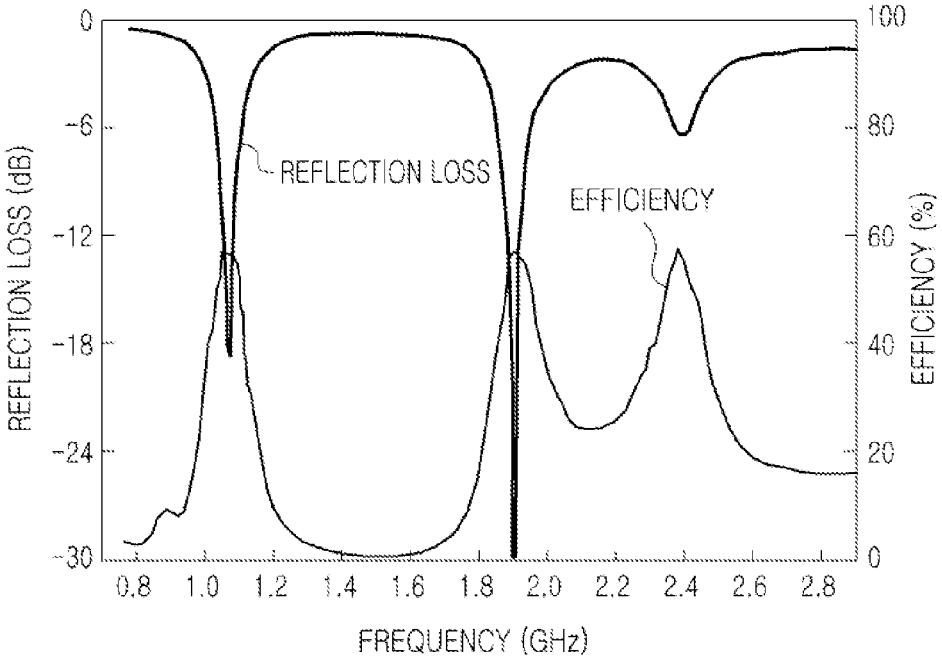
FIG. 23 is a graph showing radiation characteristics of an antenna device when a gap coupling line connected to a ground and fed by current leaking from a radiator and current leaking from the ground is added, according to an exemplary embodiment of the present invention.

FIG. 23 is a graph showing radiation characteristics of an antenna device when a gap coupling line connected to a ground and fed by current leaking from a radiator and current leaking from the ground is added, according to an exemplary embodiment of the present invention.

Referring to FIG. 23, shown are results of a measurement of the radiation characteristics of the antenna device when the second radiation pattern is formed using the third scheme in the radiation pattern shown in FIG. 2 according to an exemplary embodiment of the present invention. As can be seen in FIG. 23, when the second radiation pattern is formed using the third scheme, resonance frequency is also secured in a frequency band around 2.4 GHz with a small change in resonance frequency of a low-frequency band in the original resonance frequency.

As such, an additional resonance frequency can be secured by forming the gap coupling line, thereby diversifying the usable frequency band of the terminal.

Figure 24:
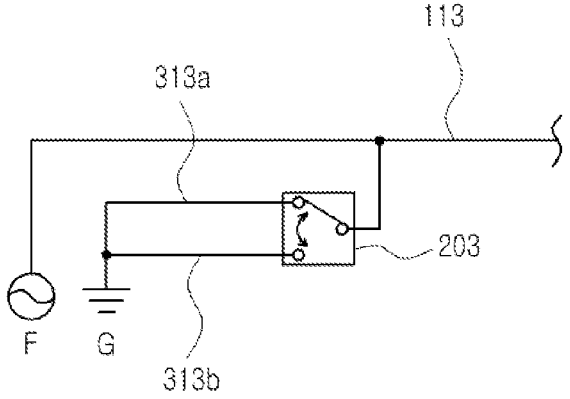
FIG. 24 is a view for describing an operating principle of a switch module that can be added to a radiation pattern in a process of fabricating an antenna device, according to an exemplary embodiment of the present invention.

FIG. 24 is a view for describing an operating principle of a switch module that can be added to a radiation pattern in a process of fabricating an antenna device, according to an exemplary embodiment of the present invention.

Figure 25:
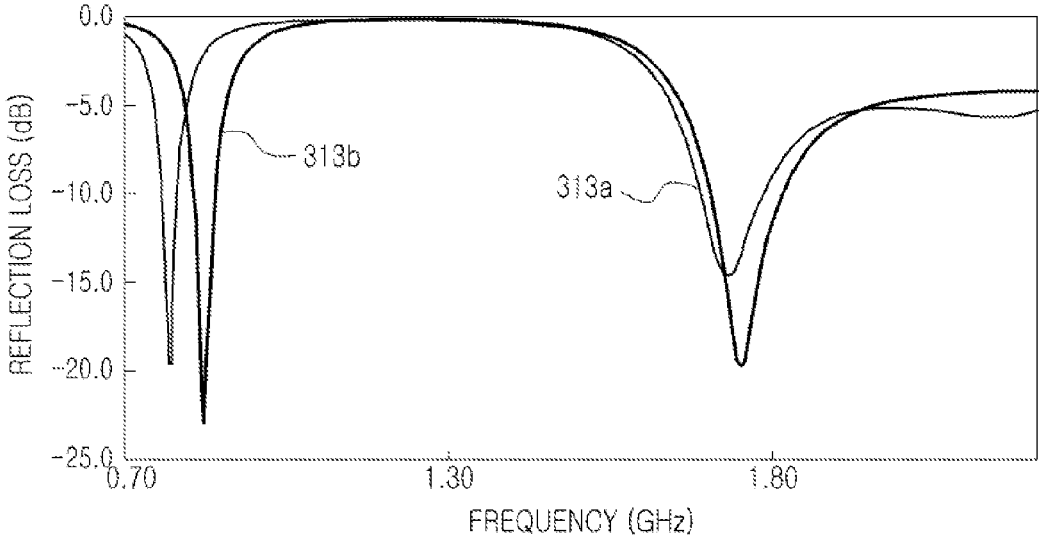
FIG. 25 is a graph showing a radiation characteristic change of an antenna device before and after a switch module shown in FIG. 24 operates, according to an exemplary embodiment of the present invention.

FIG. 25 is a graph showing a radiation characteristic change of an antenna device before and after a switch module shown in FIG. 24 operates, according to an exemplary embodiment of the present invention.

Referring to FIG. 24, a structure is shown for controlling resonance frequency by using additional radiation patterns ('third radiation patterns') 313*a* and 313*b* and a switch module 203. Referring to FIG. 25, a change in radiation characteristics of an antenna device is shown, more specifically, the radiation pattern 113, with the operation of the switch module 203 shown in FIG. 24.

The third radiation patterns 313*a* and 313*b* are formed as a pair in connection with the ground, but they are not necessarily formed as a pair and are not necessarily connected to the ground G, as long as they are selectively connected by the switch module 203 to the radiation pattern ('first radiation pattern') 113 already formed in the printed circuit on the circuit board. If any one of the third radiation patterns 313*a* and 313*b* is connected to the first radiation pattern 113 by the operation of the switch module 203, even if not being connected to the ground G, the electrical and physical length of the entire radiation pattern becomes different from that of the first radiation pattern 113 itself, thereby making the resonance frequency different.

Even when a structure using a gap coupling line or a switch module is added, the radiation characteristics of the radiation pattern can be controlled by using magneto dielectric modules, dielectric modules, and radiators in the tuning in step 17 of FIG. 1.

Figure 28:
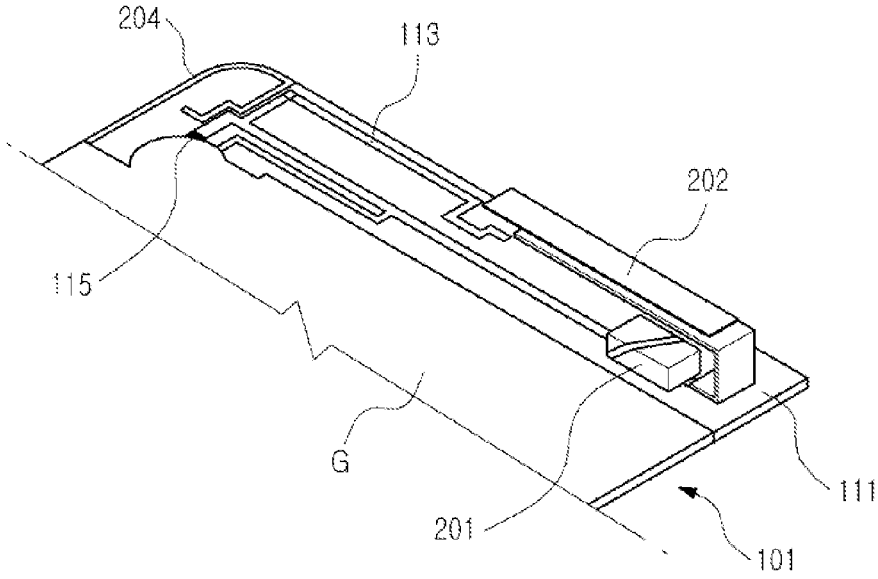
FIG. 28 illustrates an antenna device fabricated by a fabrication method, according to an exemplary embodiment of the present invention.

FIG. 28 illustrates an antenna device fabricated by a fabrication method, according to an exemplary embodiment of the present invention.

Figure 29:
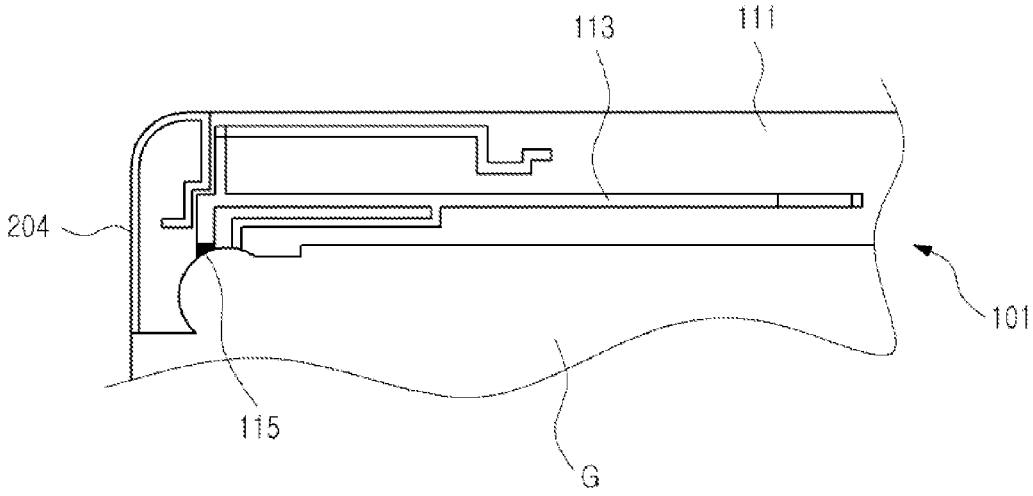
FIG. 29 is a plan view showing a radiation pattern of an antenna device shown in FIG. 28, according to an exemplary embodiment of the present invention.

FIG. 29 is a plan view showing a radiation pattern of an antenna device shown in FIG. 28, according to an exemplary embodiment of the present invention.

Referring to FIG. 28, an antenna device 300 fabricated through the aforementioned process is shown. Referring to FIGS. 28 and 29, the first radiation pattern 113 and the second radiation pattern 204 are formed on a PCB 101, at an end of which is provided an antenna space 111 for forming the first radiation pattern 113 and the second radiation pattern 204 and at another portion of which is provided the ground G. The first radiation pattern 113 includes a feeding end 115 at an end thereof and a partial pattern extending from a portion thereof is connected to the ground G. The second radiation pattern 204 is connected to the ground G, and a portion thereof is adjacent to a portion of the first radiation pattern 113. This scheme is the above-described second scheme, that is, a scheme where the second radiation pattern 204 is fed by both current leaking from the first radiation pattern and current leaking from the ground.

In the first radiation pattern 113, a single magneto dielectric module 201 and a single radiator 202 are disposed. This is intended to meet a specification required for the antenna device, eventually, a target terminal, by controlling radiation characteristics implemented by the first radiation pattern and the second radiation pattern.

Figure 30:
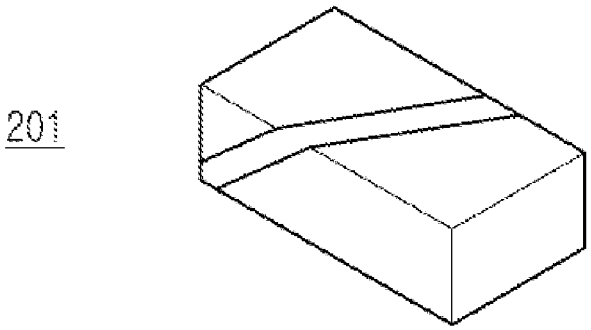
FIG. 30 is a perspective view showing a magneto dielectric module of an antenna device shown in FIG. 28, according to an exemplary embodiment of the present invention.

FIG. 30 is a perspective view showing a magneto dielectric module of an antenna device shown in FIG. 28, according to an exemplary embodiment of the present invention.

Referring to FIG. 30, the magneto dielectric module 201 is selected from the magneto dielectric modules shown in FIG. 26, which has a size of 2 mm (width)×4 mm (length)×1 mm (thickness) and is wound once with a conductor on an outer circumferential surface thereof.

Figure 31:
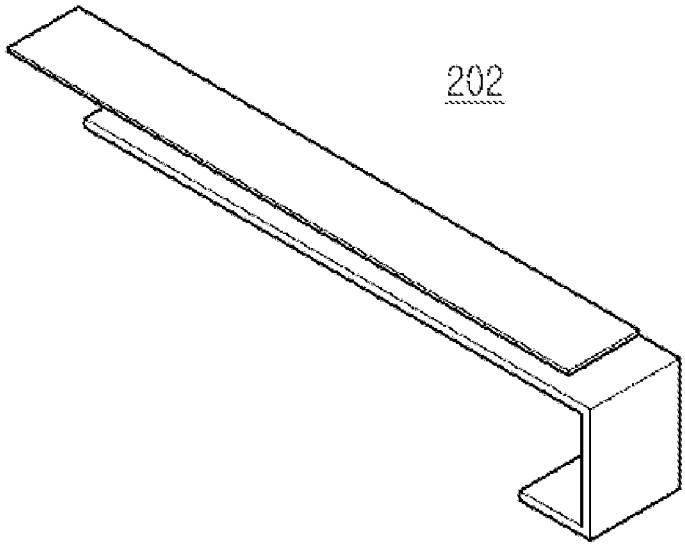
FIG. 31 is a perspective view showing a radiator of an antenna device shown in FIG. 28, according to an exemplary embodiment of the present invention.

FIG. 31 is a perspective view showing a radiator of an antenna device shown in FIG. 28, according to an exemplary embodiment of the present invention.

Referring to FIG. 31, the radiator 202 provides a cubic radiation structure to the first radiation pattern and the second radiation pattern which are formed in flat shapes, and improves bandwidth and efficiency which may be limited with the first radiation pattern and the second radiation pattern.

Figure 32:
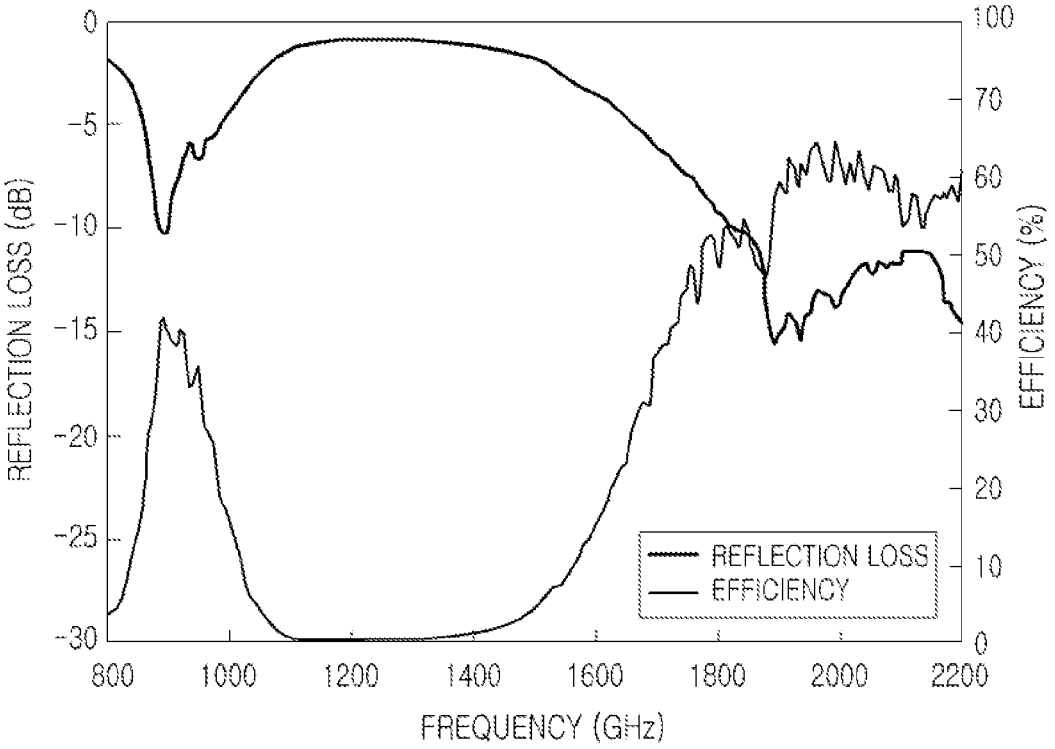
FIG. 32 is a graph showing radiation characteristics of an antenna device shown in FIG. 28, according to an exemplary embodiment of the present invention.

FIG. 32 is a graph showing radiation characteristics of an antenna device shown in FIG. 28, according to an exemplary embodiment of the present invention.

Referring to FIG. 32, results are shown of a measurement of radiation characteristics of an antenna device shown in FIG. 28.

As shown in FIG. 32, it can be seen that the antenna device shown in FIG. 28 can be used in four frequency bands. The number of usable frequency bands of the antenna device may vary according to the form of a radiation pattern, whether or not the gap coupling line or the switch module is used, or the number of gap coupling lines or switch modules used.

As such, the method for fabricating an antenna device according to the exemplary embodiments of present invention previously selects pattern configurations which can be directly formed on a PCB, such as a radiation pattern, a gap coupling line, and the like, according to the exterior and usable frequency band of the terminal, and fabricates the antenna device by selecting a proper one of the selected pattern configurations in a stage of planning the target terminal, while controlling radiation characteristics of the selected pattern configuration according to the specification of the terminal by using magneto dielectric modules, dielectric modules, and radiators. An element used to control the radiation characteristics, such as the magneto dielectric module, is also one of previously selected and/or fabricated elements. Consequently, the antenna device can be fabricated without repeating designing, testing, and redesigning based on test results in a process of fabricating a new terminal.

Although the selected pattern configuration may be partially modified in a stage of controlling radiation characteristics, especially, resonance frequency, such modification is intended to finely control the radiation characteristics of the antenna device and is performed more simply than the redesigning based on test results.

While the invention has been shown and described with reference to certain exemplary embodiment thereof, it will be understood by those skilled in the art that various changes in form and details may be made therein without departing from the spirit and scope of the invention as defined by the appended claims and their equivalents.

What is claimed is:

1. A method for fabricating an antenna device of a mobile communication terminal, the method comprising:

selecting one or more radiation patterns according to a usable frequency band, the one or more radiation patterns each comprising one or more resonance frequencies;

selecting and fabricating magneto dielectric modules for controlling the one or more resonance frequencies of the selected one or more radiation patterns;

selecting and fabricating dielectric modules for controlling the one or more resonance frequencies of the selected one or more radiation patterns;

selecting and fabricating one radiation pattern among the selected one or more radiation patterns, the fabricated radiation pattern comprises a number of resonance frequencies required for the terminal; and selecting and installing at least one of the magneto dielectric modules and the dielectric modules in a selected position on the fabricated radiation pattern to tune the one or more resonance frequencies of the fabricated radiation pattern according to the resonance frequencies required for the terminal.

2. The method of claim 1, wherein the selecting and fabricating of the radiation pattern comprises forming the fabricated radiation pattern in a form of a printed circuit on a printed circuit board embedded in the terminal.

3. The method of claim 1, wherein the selecting and installing of the at least one of the magneto dielectric modules and the dielectric modules in the fabricated radiation pattern comprises, selecting at least one of the magneto dielectric modules and installing the selected magneto dielectric module adjacent to a feeding end of the fabricated radiation pattern.

4. The method of claim 1, wherein each of the magneto dielectric modules are fabricated by:

forming a body made of a magneto dielectric material; and installing a conductor on an outer circumferential surface of the body.

5. The method of claim 4, wherein the conductor comprises an essentially helical shape which is wound one or more times around the body.

6. The method of claim 4, wherein the conductor is provided to surround an outer circumferential surface of the body.

7. The method of claim 4, wherein the selecting and fabricating of the magneto dielectric module comprises determining a magneto dielectric material comprising a permeability of 2-9 in accordance with the tuned resonance frequencies.

8. The method of claim 1, wherein the selecting and installing of the at least one of the magneto dielectric modules and the dielectric modules in the fabricated radiation pattern comprises, selecting at least one of the dielectric modules and installing the selected dielectric module is spaced apart from a feeding end of the fabricated radiation pattern and adjacent to an end portion of the fabricated radiation pattern.

9. The method of claim 8, wherein the selecting and fabricating of the dielectric module comprises determining a permittivity of 1-10 of the fabricated dielectric module in accordance with the tuned resonance frequencies.

10. The method of claim 1, wherein the selecting and installing of the at least one of the magneto dielectric modules and the dielectric modules in the fabricated radiation pattern comprises installing a separate radiator on the fabricated radiation pattern through surface-mounting, the radiator being fabricated by performing sheet metal working on a metal sheet.

11. The method of claim 1, further comprising, after the selecting and fabricating of the radiation pattern, forming a second radiation pattern, the second radiation pattern being adjacent to and spaced apart from the fabricated radiation pattern.

12. The method of claim 11, wherein the second radiation pattern comprises a gap coupling line fed by current leaking from a ground or from the fabricated radiation pattern.

13. The method of claim 1, further comprising, after the selecting and fabricating of the radiation pattern, forming a third radiation pattern adjacent to the fabricated radiation pattern and installing a switch module for selectively connecting the third radiation pattern to the fabricated radiation pattern.

14. The method of claim 13, wherein the selecting and fabricating of the radiation pattern comprises forming the fabricated radiation pattern in a form of a printed circuit on a printed circuit board embedded in the terminal, the third radiation pattern being formed on the printed circuit board.

15. The method of claim 14, wherein at least a pair of the third radiation patterns is formed independently, and the switch module connects one of the pair of the third radiation patterns to the fabricated radiation pattern.

16. The method of claim 14, wherein the third radiation pattern is formed connected to a ground of the circuit board.

17. The method of claim 1, wherein, when a specification of the terminal is changed, the selecting and fabricating of the radiation pattern and the selecting and installing of the at least one of the magneto dielectric modules and the dielectric modules in the radiation pattern are repeated in accordance with the one or more resonance frequencies required for the terminal in accordance with the changed specification of the terminal.

* * * * *